US008579605B2

(12) United States Patent
Wang

(10) Patent No.: US 8,579,605 B2
(45) **Date of Patent: *Nov. 12, 2013**

(54) DC-AC FREQUENCY CONVERTER TYPE MUCUS SUCTION DEVICE

(75) Inventor: Ming Yang Wang, Nantou (TW)

(73) Assignee: Jackey Chiou, Nantou (TW)

( * ) Notice: Subject to any disclaimer, the term of this patent is extended or adjusted under 35 U.S.C. 154(b) by 537 days.

This patent is subject to a terminal disclaimer.

(21) Appl. No.: 12/775,497

(22) Filed: May 7, 2010

(65) Prior Publication Data

US 2010/0286597 A1 Nov. 11, 2010

Related U.S. Application Data

(63) Continuation-in-part of application No. 12/231,218, filed on Aug. 29, 2008, now abandoned, which is a continuation-in-part of application No. 11/378,942, filed on Mar. 17, 2006, now abandoned.

(51) Int. Cl.
*F04B 17/03* (2006.01)
*H02K 33/00* (2006.01)

(52) U.S. Cl.
USPC ..... 417/413.1; 318/124; 318/126; 318/129; 318/132

(58) Field of Classification Search
USPC ..... 417/413.1; 318/123–126, 129, 132
See application file for complete search history.

(56) References Cited

U.S. PATENT DOCUMENTS

| | | | | |
|---|---|---|---|---|
| 3,340,052 | A * | 9/1967 | Inoue | 419/19 |
| 3,875,483 | A * | 4/1975 | Farr | 318/807 |
| 4,374,330 | A * | 2/1983 | Fey | 307/132 E |
| 5,106,274 | A * | 4/1992 | Holtzapple | 417/388 |
| 5,137,432 | A * | 8/1992 | Tsai | 417/312 |
| 6,168,392 | B1 * | 1/2001 | Takano | 417/312 |
| 6,340,069 | B1 * | 1/2002 | Wang | 181/272 |
| 2012/0053519 | A1 * | 3/2012 | Wang | 604/131 |
| 2012/0082574 | A1 * | 4/2012 | Wang | 417/412 |

* cited by examiner

*Primary Examiner* — Charles Freay
(74) *Attorney, Agent, or Firm* — Raymond Y. Chan; David and Raymond Patent Firm

(57) ABSTRACT

The present invention provides a DC-AC frequency converter type mucus suction device having an electromagnetic pump, the pressure and the flow generated in which could be changed to satisfy the requirement of the mucus suction device. The mucus suction device of the present invention comprises an electromagnetic pump, a suction device and a frequency converter circuit, wherein the frequency converter circuit at least comprises an oscillator circuit, a bistable circuit, and a push-pull circuit, wherein the electromagnetic pump is supplied with AC obtained from the oscillation of DC in the frequency converter circuit, wherein the swing speed, frequency and amplitude of the swing arms vary with the oscillation frequency of the oscillator circuit, such that the suction pressure and the suction flow of the electromagnetic pump could further be changed to obtain the most appropriate pressure and flow of the mucus suction device.

23 Claims, 24 Drawing Sheets

DC-AC FREQUENCY CONVERTER TYPE MUCUS SUCTION DEVICE

CROSS REFERENCE OF RELATED APPLICATION

This is a continuation-in-part application that claims the benefit of priority under 35 U.S.C. §119 to a non-provisional application, application Ser. No. 12/231,218, filed Aug. 29, 2008, and is now abandoned.

BACKGROUND OF THE PRESENT INVENTION

1. Field of Invention

The present invention relates to a DC-AC frequency converter type mucus suction device for removing things from the inside of the nose of a user, and more particularly relates to a mucus suction device with an electromagnetic pump supplied with AC obtained from the oscillation of DC, herein the speed, frequency, and amplitude of the swinging of the swing arms of the electromagnetic pump vary with the frequency of the switching between the N-phase and S-phase of the electromagnetic device, so that the suction pressure and the suction flow generated in the electromagnetic pump will satisfy the requirement of the mucus suction device.

2. Description of Related Arts

Referring to FIGS. 1-7, an electromagnetic pump 20 is disclosed, which could also be called as a swing arm pump or a matrix type pump. The electromagnetic pump 20 is light in weight and could be operated with less noise, lower power consumption and less chance to generate high heat, and the electronic circuit of the electromagnetic pump is hard to start when the inlet and the outlet channels are blocked. Considering these shortcomings, the applicant of the present invention adopted the electromagnetic pump as the power source of the electric nose suction device claimed in the Taiwan patent application No. 093217312 filed in 2004, in which the electromagnetic pump 20 has an electromagnetic device 27 on one side and a pump housing 21 on the other side. Each of two outer opposing sides (or one can say opposing members) of the pump housing 21 provides a stretchable and elastic hat 24, which further provides a swing arm 25 respectively thereon, wherein one end of each swing arm 25 is disposed on the outer side of the pump housing 21 and a magnetic member 26 is provided on the other end of each swing arm 25 at a site remote from the electromagnetic device 27. The inside of the pump housing 21 is divided into two chambers 211 and 212, wherein the first chamber 211 is communicated with two inlet tubes 22 and the second chamber 212 is communicated with two outlet tubes 23. Referring to FIGS. 2 and 3, the electromagnetic device 27 has two side magnetic members 271 and a middle magnetic member 272, wherein the magnetism of the three members alternate between N-phase and S-phase. The two magnetic members 26 are disposed opposite to the two side magnetic members 271 respectively and have N-phase outside surfaces and S-phase inside surfaces respectively. As shown in FIG. 2, when the two side magnetic members 271 of the electromagnetic device 27 switch to N-phase and the middle magnetic member 272 switches to S-phase, the two magnetic members 26 are attracted by the middle magnetic member 272 and repulsed by the two side magnetic members 271 to bring the swing arms 25 towards the middle. In contrast with FIG. 3, when the two side magnetic members 271 of the electromagnetic device 27 switch to S-phase and the middle magnetic member 272 switches to N-phase, the two magnetic members 26 are repulsed by the middle magnetic member 272 and are attracted by the two side magnetic members 271 to bring the swing arms 25 towards the outside. The speed, frequency and amplitude of the swinging of the swing arms are relative to the predetermined frequency of the power source, and also relative to the suction pressure and the suction flow. Referring to FIGS. 4-7, when the swing arms 25 swing towards the outside to expand the hats 24 respectively, the two first check valves 241 respectively provided between the pump housing 21 and the hats 24 are set to open to allow fluid flow into the first chamber 211 through the inlet tubes 22 on the outside of the pump; the fluid flows into the two hats 24, and then is stopped from flowing into the second chamber 212 by two second check valves 242, as the two second check valves 242 are turned off. And when the two swing arms 25 swing towards the middle to compress the two hats 24 respectively, the two second check valves 242 are turned on and the first check valves 241 are turned off, hence the fluid in the two hats 24 could only flow into the second chamber 212, but reflow back into the first chamber 211, substantially the fluid in the second chamber 212 is discharged from the pump housing 21 through the two outlet tubes 23. With the designs mentioned above, the pump housing 21 draws a fluid from the inlet tubes 22 and then discharges the fluid from the outlet tube 23 to accomplish the transporting of the fluid. As shown in FIG. 8, the inlet tubes 22 connect to a suction device 80, so that the suction device 80 could be used to draw mucus.

The electromagnetic pump 20 must be supplied with AC to drive the two swing arms 25—back and forth. However, as the voltage of the domestic electricity used in the countries worldwide is 110V or 220V, for example, the domestic electricity in Taiwan is single phase electricity with a voltage of 110V and a frequency of 60 HZ. When alternating electricity of 110V and 60 HZ is used as the power source of the electromagnetic pump 20, the speed, frequency and amplitude of the swinging of the swing arms 25 of the electromagnetic pump 20 are fixed and could not be adjusted due to a combined effect of the magnetic field strength generated in the electromagnetic device 27, the length and width of the swing arms 25, the magnetic strength of the magnetic members 26, and the elasticity of the hats 24. That means the pressure and the flow of the suction, or the pressure and the flow of the discharge of the electromagnetic pump 20 could not be adjusted according to the requirement of the pressure and/or the flow. Hence, when the electromagnetic pump 20 is used to draw the mucus, the suction force might be so large to cause damage to the nasal mucosa, or be too small to draw the mucus off. Hence, the electromagnetic pump 20 needs to be improved.

SUMMARY OF THE PRESENT INVENTION

The present invention is predicated on the observation that the current mucus suction device could only use the electromagnetic pump supplied with the 110V AC as the power source.

The invention is advantageous in that it provides a mucus suction device with a frequency converter circuit, which oscillates to convert DC into AC supplied to a electromagnetic pump of the suction device, wherein the frequency of the oscillation of the frequency converter circuit could be changed to adjust the suction pressure and the suction flow of the electromagnetic pump in order to obtain a most appropriate suction pressure and flow of the mucus suction device.

Another advantage of the invention is to provide a mucus suction device which uses a general-purpose power source, such as battery, in-car cigarette lighter, transformer rectifier unit (TRU) or the other suitable device providing DC.

Accordingly, the mucus suction device could be widely used in any place with a suitable power source.

Another advantage of the invention is to provide a mucus suction device with a frequency converter circuit, which further links to a modulation circuit, wherein when the swing arms swing outward, the modulation circuit is activated to accelerate the swing speed of the swing arms, so that the suction pressure of the electromagnetic pump is large enough to draw viscous mucus or rhinolith out by the mucus suction devices.

According to the present invention, the foregoing and other objects and advantages are attained by a mucus suction device comprising an electromagnetic pump, a frequency converter circuit, and a suction device. The frequency converter circuit oscillates to convert DC into AC, which is supplied to the electromagnetic pump. The electromagnetic pump has an electromagnetic device on one side and a pump housing on the other side, wherein at least one outside surface of the pump housing provides a stretchable and elastic hat, which further provides a swing arm thereon. One end of the swing arm is disposed an outer side of the pump housing and a magnetic member is provided on the other end of the swing arm, remote from the electromagnetic device. The inside of the pump housing is divided into two chambers including a first chamber communicated with at least one inlet tube and a second chamber communicated with at least one outlet tube, wherein the first chamber and the second chamber are arranged up and down, or back and forth, which is to say in top-bottom, or front-back relation. A check valve is provided between each chamber and corresponding hat. The swing arms swing in a reciprocating cycle to cause the electromagnetic pump draw a fluid into the chambers from the inlet tube and discharge the fluid from the outlet tube. The suction device is connected to the inlet tube of the electromagnetic pump and is used to draw mucus. The frequency converter circuit comprises an oscillator circuit, a bistable circuit and a push-pull circuit. The oscillator circuit oscillates to transform DC into a single-phase oscillating signal. The bistable circuit splits the single-phase oscillating signal into a N-phase stimulus signal and a S-phase stimulus signal, both of which respectively activate magnetism of two side magnetic members of the electromagnetic device and magnetism of a middle magnetic member of the electromagnetic device to alternating switch between N-phase and S-phase. The two side magnetic members and the middle magnetic member are attracted or repulsed by the two magnetic members respectively to force the swing arms to swing reciprocatingly. The higher the selected oscillating frequency of the oscillator circuit, the higher is the speed of switching between the N-phase and the S-phase of the electromagnetic device is, and vice-versa. The push-pull circuit amplifies and provides the N-phase stimulus signal and the S-phase stimulus signal to the electromagnetic pump to force the swing arms of the electromagnetic pump to swing. The frequency converter circuit is arranged to use DC to activate the swing arms of the electromagnetic pump to swing in a reciprocating cycle. The oscillating frequency of the oscillator circuit is adjusted to change the swing speed, swing frequency and amplitude of the swing arms of the electromagnetic pump, to effect further change in the suction pressure and flow of the electromagnetic pump. In another embodiment of the present invention, the frequency converter circuit further comprises a modulation circuit, which generates a single-phase oscillating signal. The N-phase stimulus signal and the S-phase stimulus signal generated in the bistable circuit are mixed with the single-phase oscillating signal respectively to enhance the N-phase stimulus signal while in balance with the S-phase stimulus signal, to further enhance the magnetic field strength of the N-phase of the electromagnetic device. The enhancement of the magnetic field strength of the N-phase of the electromagnetic device further causes the swing arms to swing outward with a higher speed and a greater force and swing inward with a lower speed and a smaller force; thus the suction pressure of the electromagnetic pump is increased. The modulation circuit is connected to a button or a keypad, to activate or adjust the modulation circuit. The DC inputted into the frequency converter circuit could be supplied by an in-car cigarette lighter, by a battery, or by a transformer rectifier unit.

These and other objectives, features, and advantages of the present invention will become apparent from the following detailed description, the accompanying drawings, and the appended claims.

DETAILED DESCRIPTION OF THE PREFERRED EMBODIMENT

Figure 18:
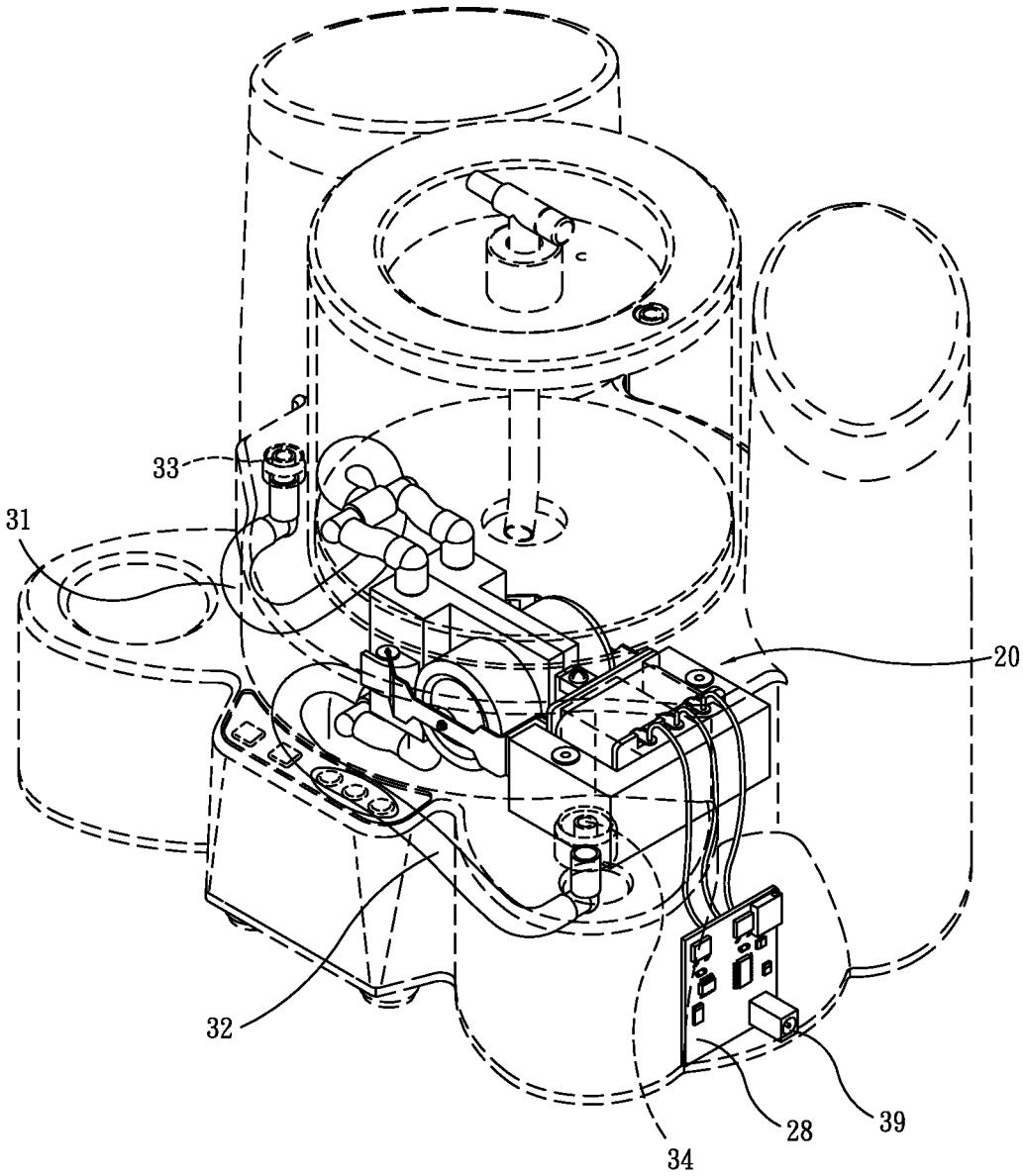
FIG. 18 is a schematic diagram of the electromagnetic pump received in a body according to the above preferred embodiment of the present invention.

Referring to FIG. 8, FIG. 9, FIG. 24, FIG. 1 and FIGS. 4 to 7, a mucus suction device according to a preferred embodiment of the present invention is illustrated, which comprises an electromagnetic pump 20, a suction device 80, a frequency converter circuit 40, wherein the frequency converter circuit 40 is provided on a circuit board 28 of the mucus suction device as shown in FIG. 18.

The electromagnetic pump 20 has an electromagnetic device 27 on one side and a pump housing 21 on the other side, wherein the electromagnetic device 27 is surrounded with coils and has a middle magnetic member 272 and two side magnetic members 271, wherein the width of the middle magnetic member 272 is larger the that of the side magnetic member 271. Each of two outside surfaces of the pump housing 21 provides a stretchable and elastic hat 24, which further provides an swing arm 25 respectively thereon, wherein one end of each swing arm 25 is disposed on the outer side of the pump housing 21 and a magnetic member 26 is provided on the other end of each swing arm 25 with a distance from the electromagnetic device 27. The inside of the pump housing 21 is divided into two chambers, i.e. a first chamber 211 in the upper portion and a second chamber 212 in the lower portion. Although the first chamber 211 and the second chamber 212 are arranged upper-and-lower in this preferred embodiment, the two chambers could also be arranged forth-and-back. The first chamber 211 is communicated with one or more than one inlet tube 22 and the second chamber 212 is communicated with one or more than on outlet tube 23. Two check valves 241 and 242 are respectively provided between the sides of the chambers 211, 212 and the hats 24. Due to the reciprocating of swing arms 25, the electromagnetic pump 20 draws a fluid into the chambers from the inlet tubes 22 and then discharges the fluid from the outlet tubes 23. The movement of the electromagnetic pump 20 has already been illustrated in FIGS. 2 to 7.

The suction device 80 is connected to the inlet tubes 22 of the electromagnetic pump 20 and is used to draw mucus. The suction device 80 has a suction tip 81, for inserting into a nasal cavity, and a mucus container 82. The suction device 80 mentioned above is only used as an embodiment of the present invention and should not be used to limit the suction device of the present invention.

Figure 1:
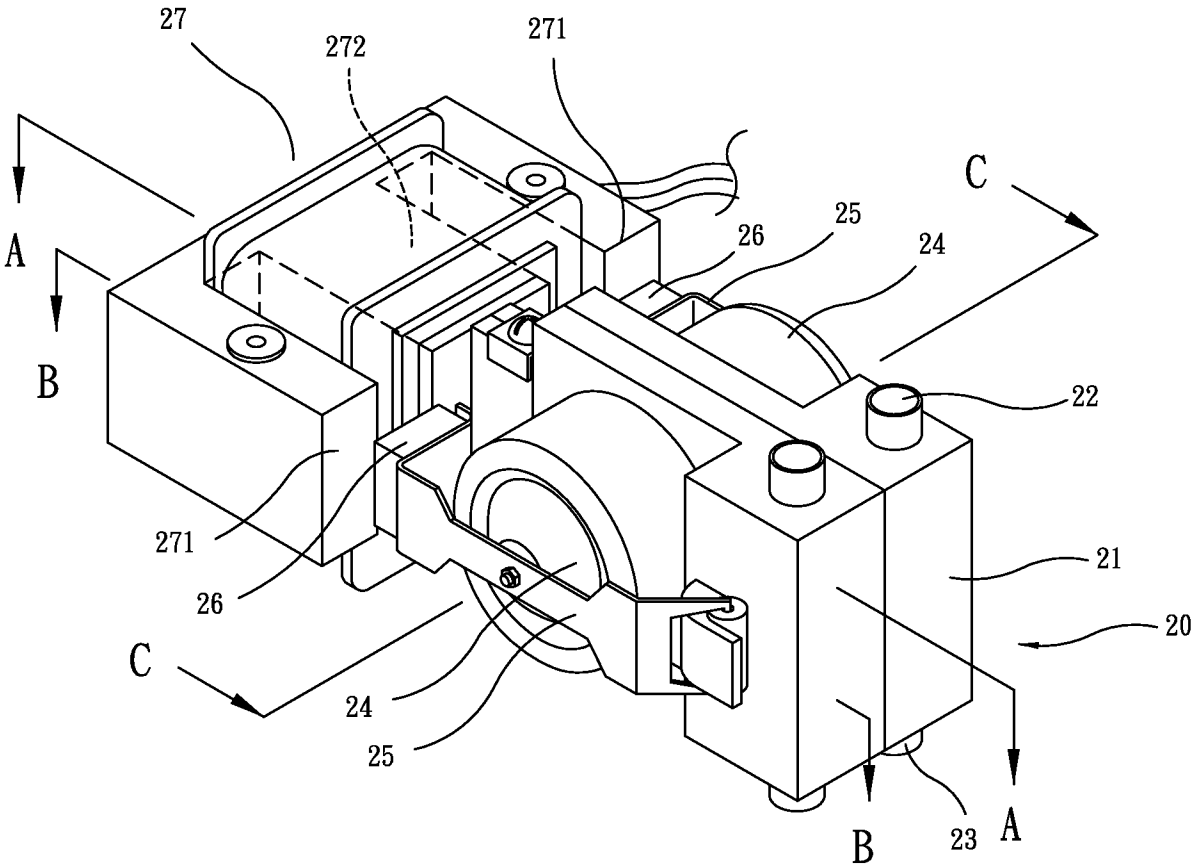
FIG. 1 is a schematic diagram of an electromagnetic pump according to a preferred embodiment of the present invention.
Figure 2:
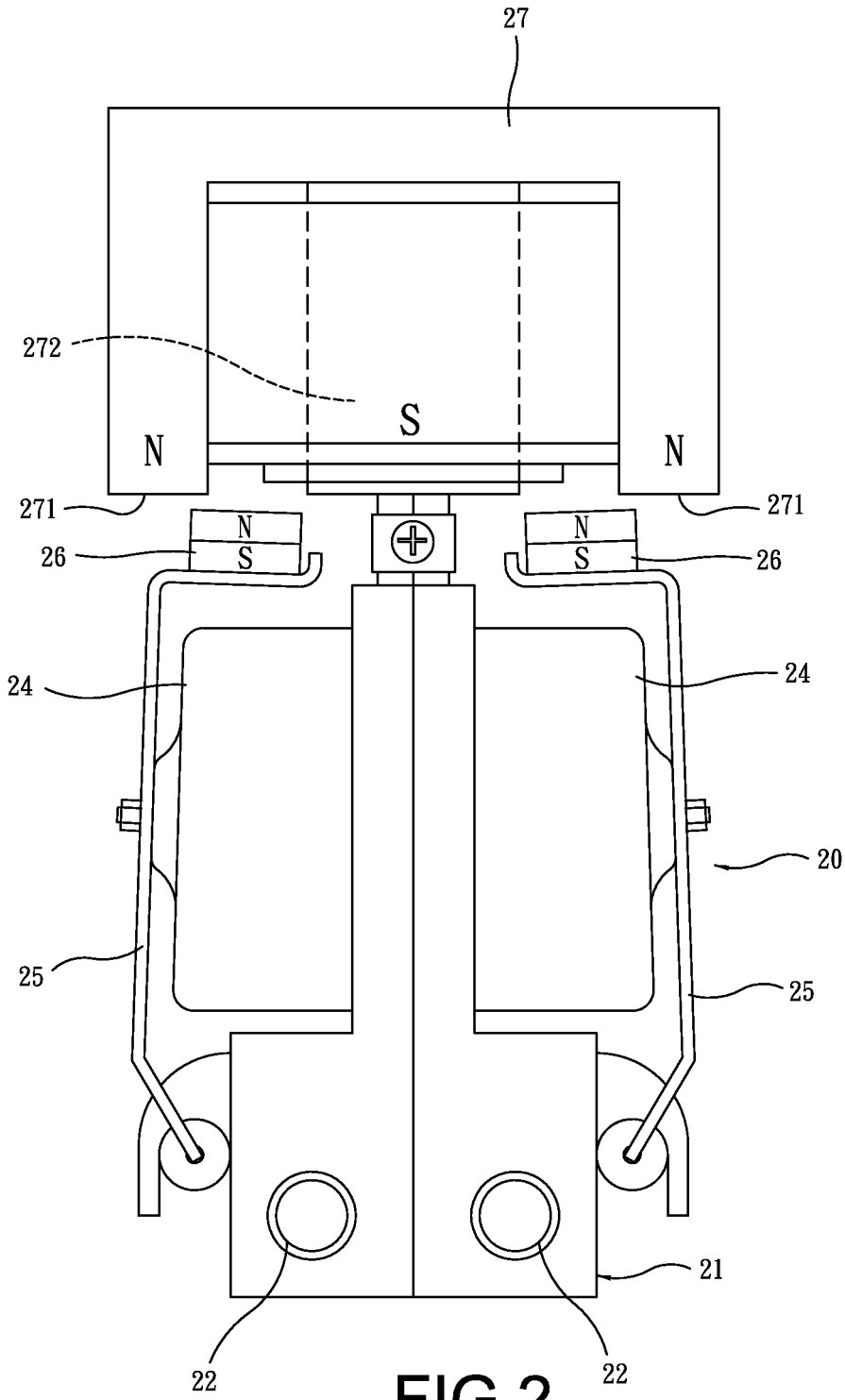
FIG. 2 is a schematic diagram of the electromagnetic with the swing arms swinging inward according of FIG. 1.
Figure 3:
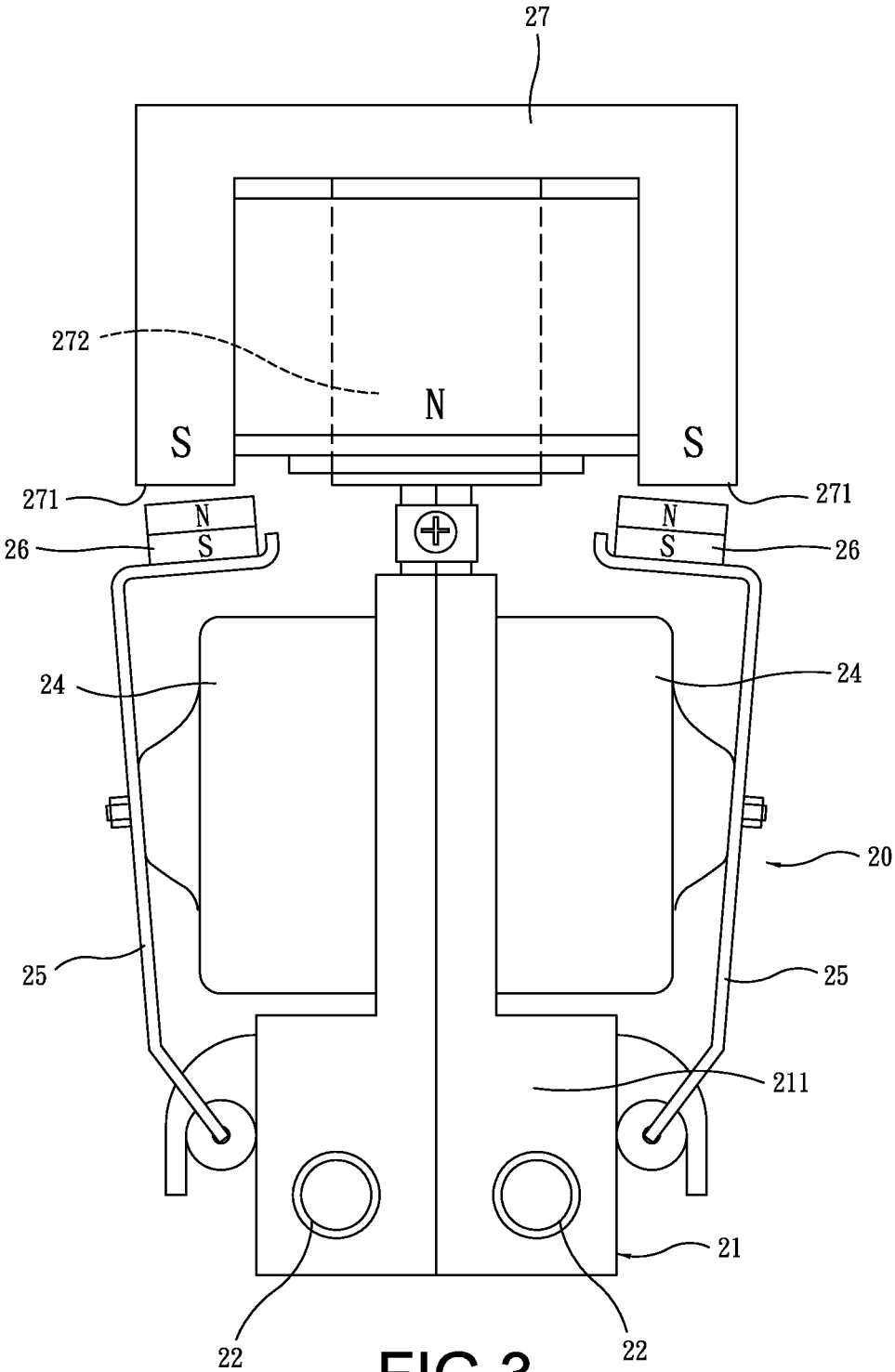
FIG. 3 is a schematic diagram of the electromagnetic with the swing arms swinging outward of FIG. 1.
Figure 4:
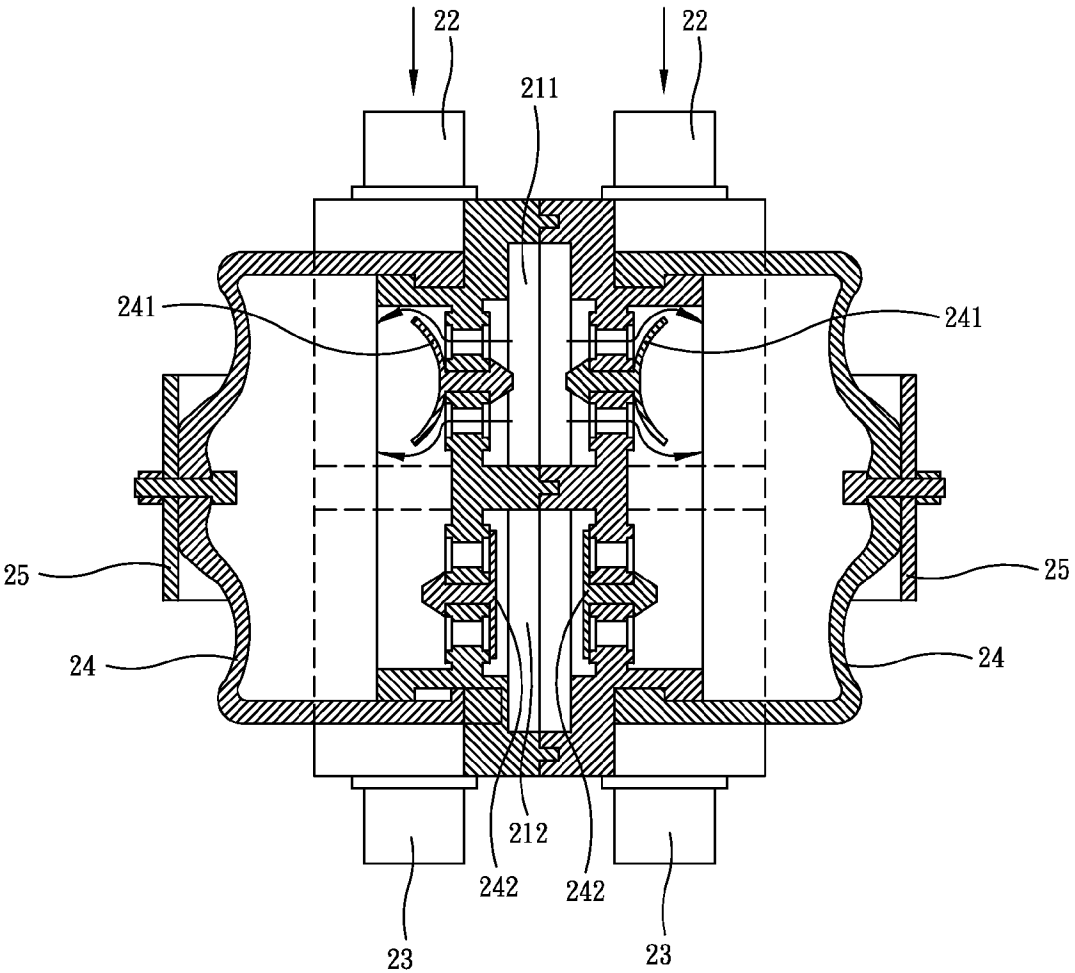
FIG. 4 is a C-C section view of the electromagnetic pump of FIG. 1 illustrating the flow direction of the fluid drawn by the electromagnetic pump.
Figure 5:
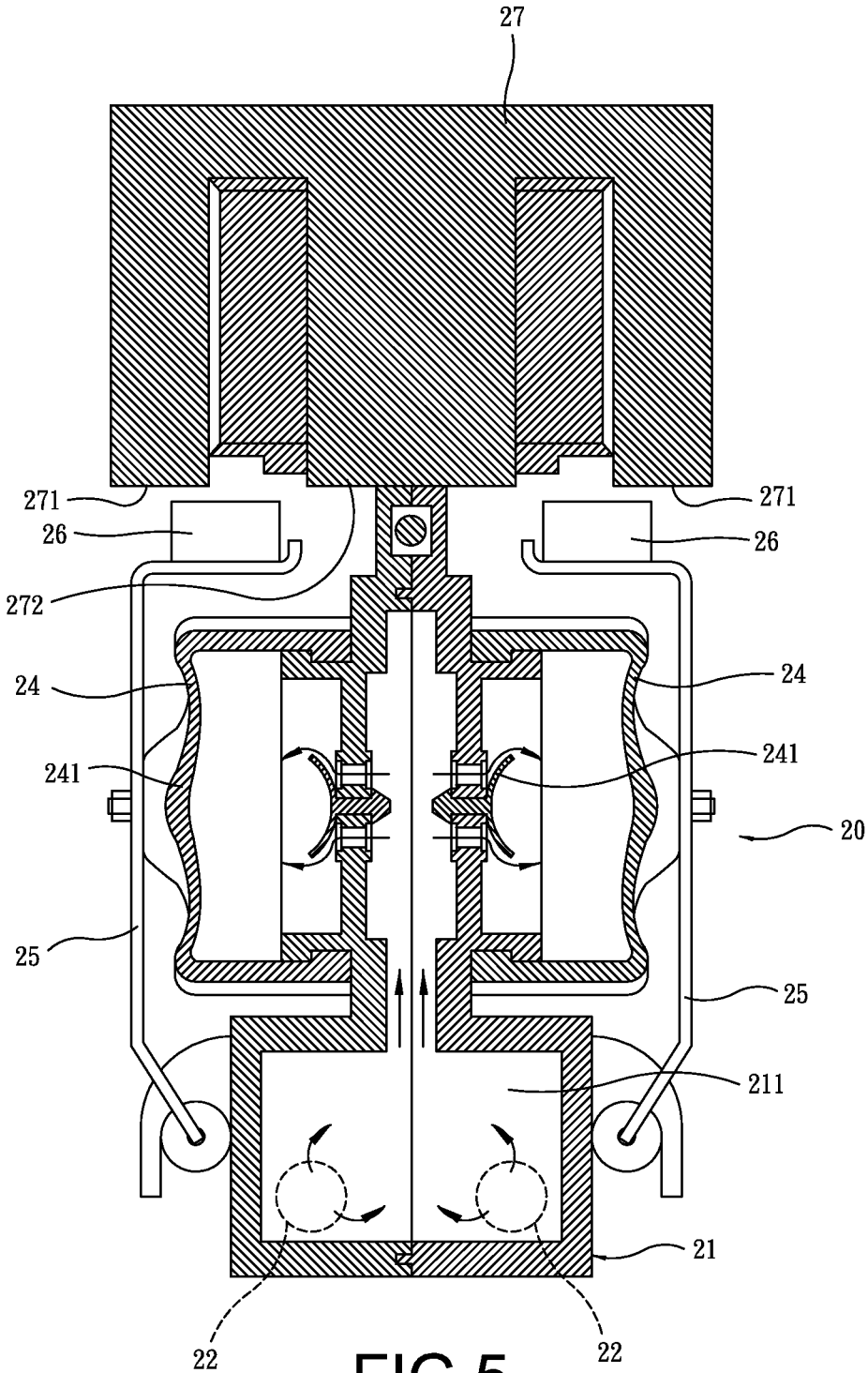
FIG. 5 is an A-A section view of the electromagnetic pump of FIG. 1 illustrating the flow direction of the fluid drawn by the electromagnetic pump.
Figure 6:
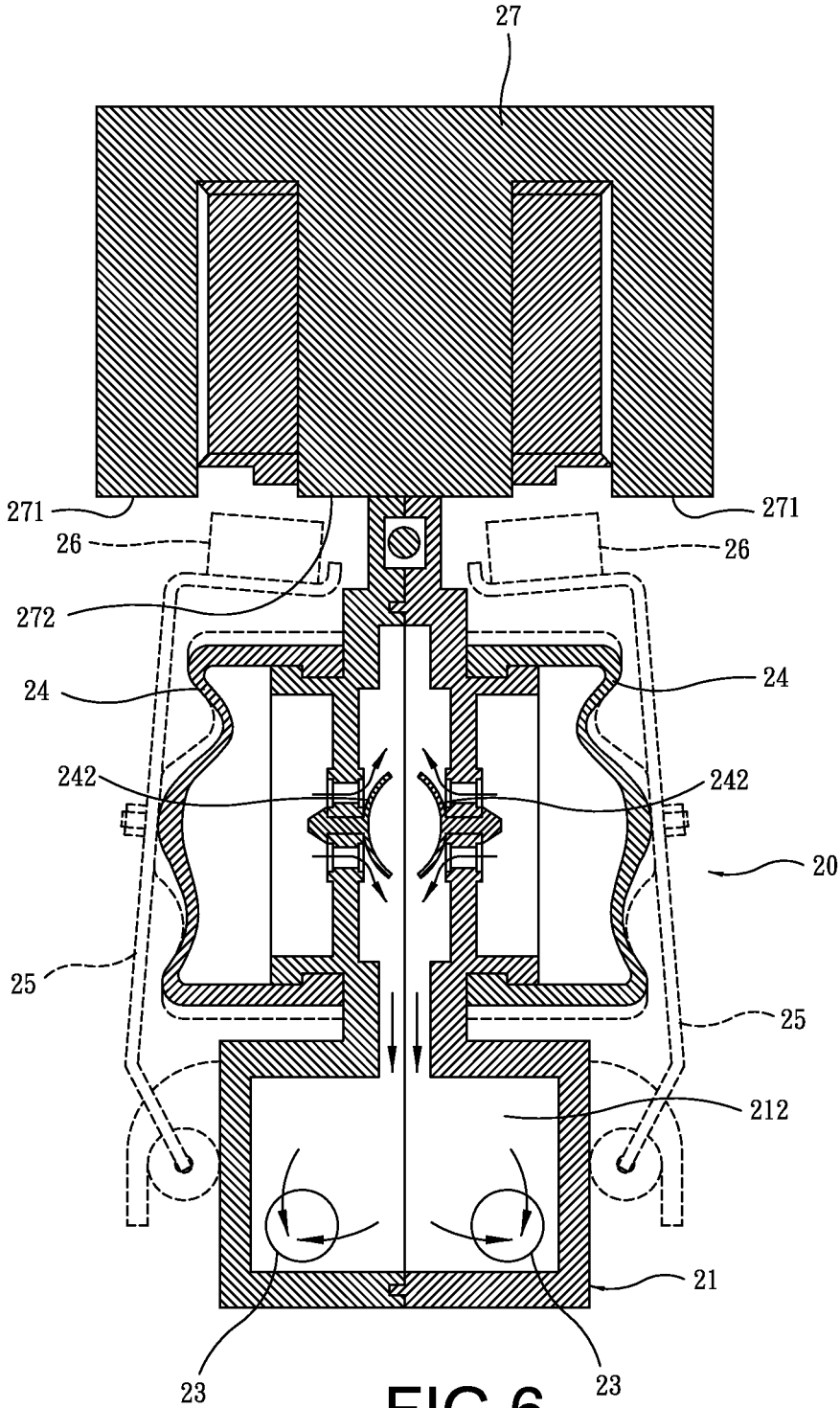
FIG. 6 is a B-B section view of the electromagnetic pump of FIG. 1 illustrating the flow direction of the fluid discharged by the electromagnetic pump.
Figure 7:
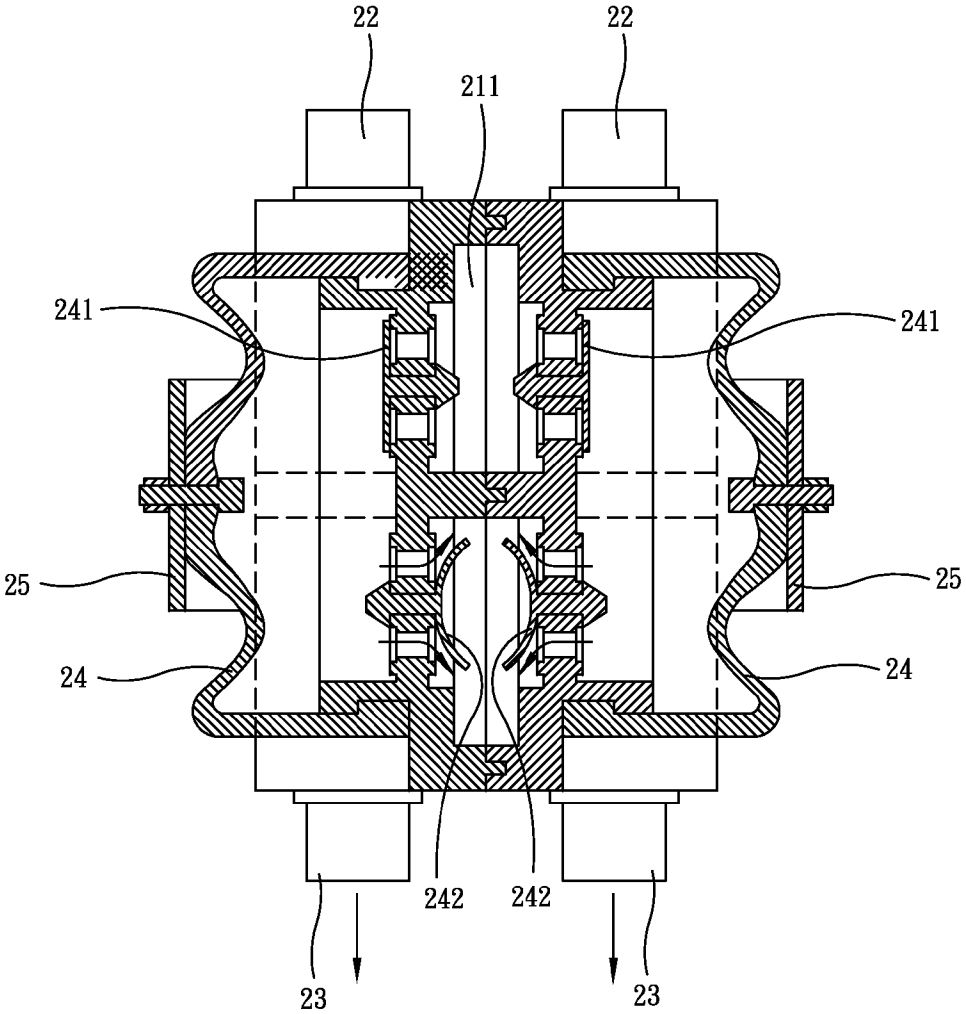
FIG. 7 is a C-C section view of the electromagnetic pump of FIG. 1 illustrating the flow direction of the fluid discharged by the electromagnetic pump.
Figure 8:
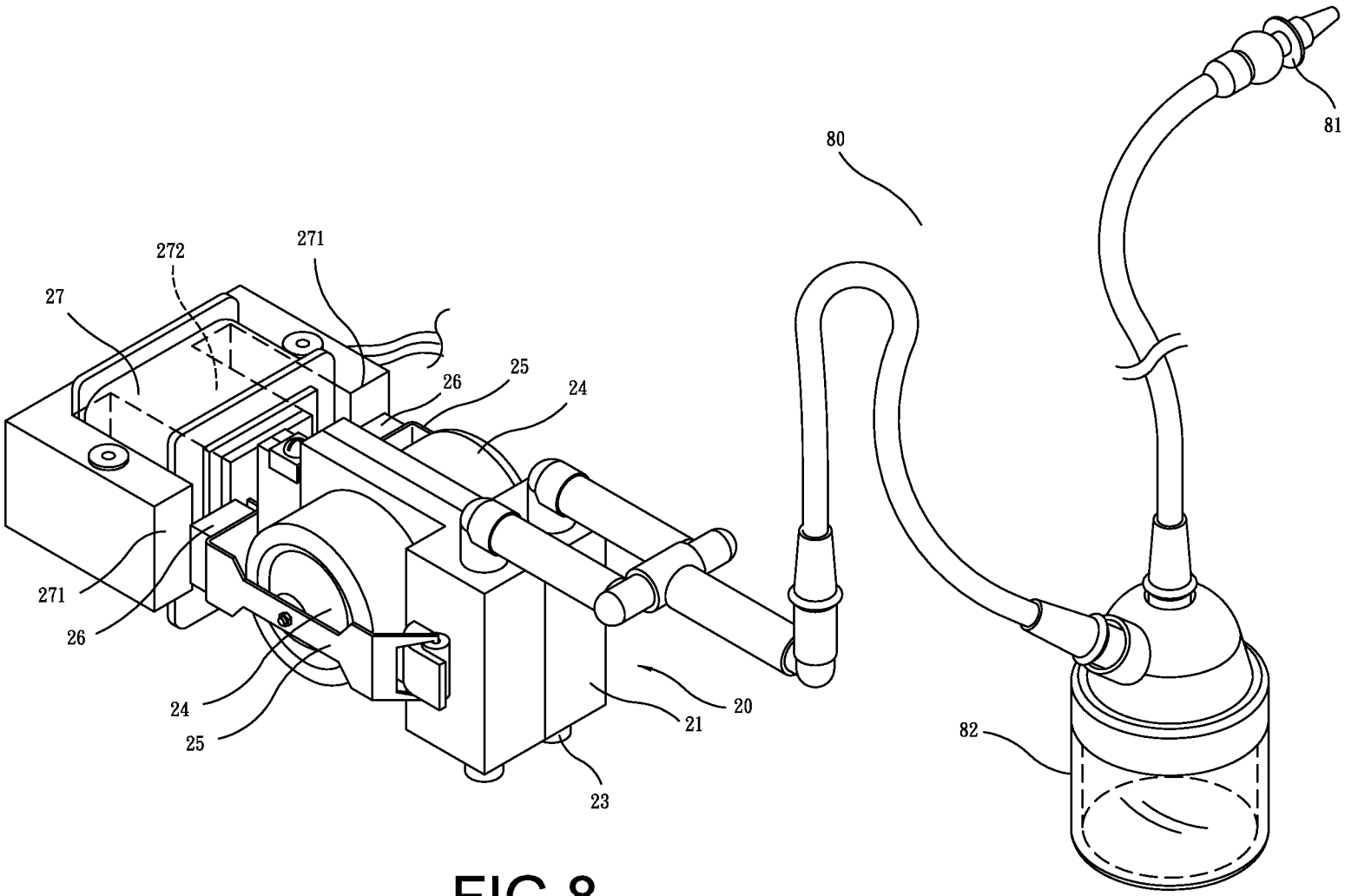
FIG. 8 is a perspective view of a mucus suction device according to the above preferred embodiment of the present invention.
Figure 9:
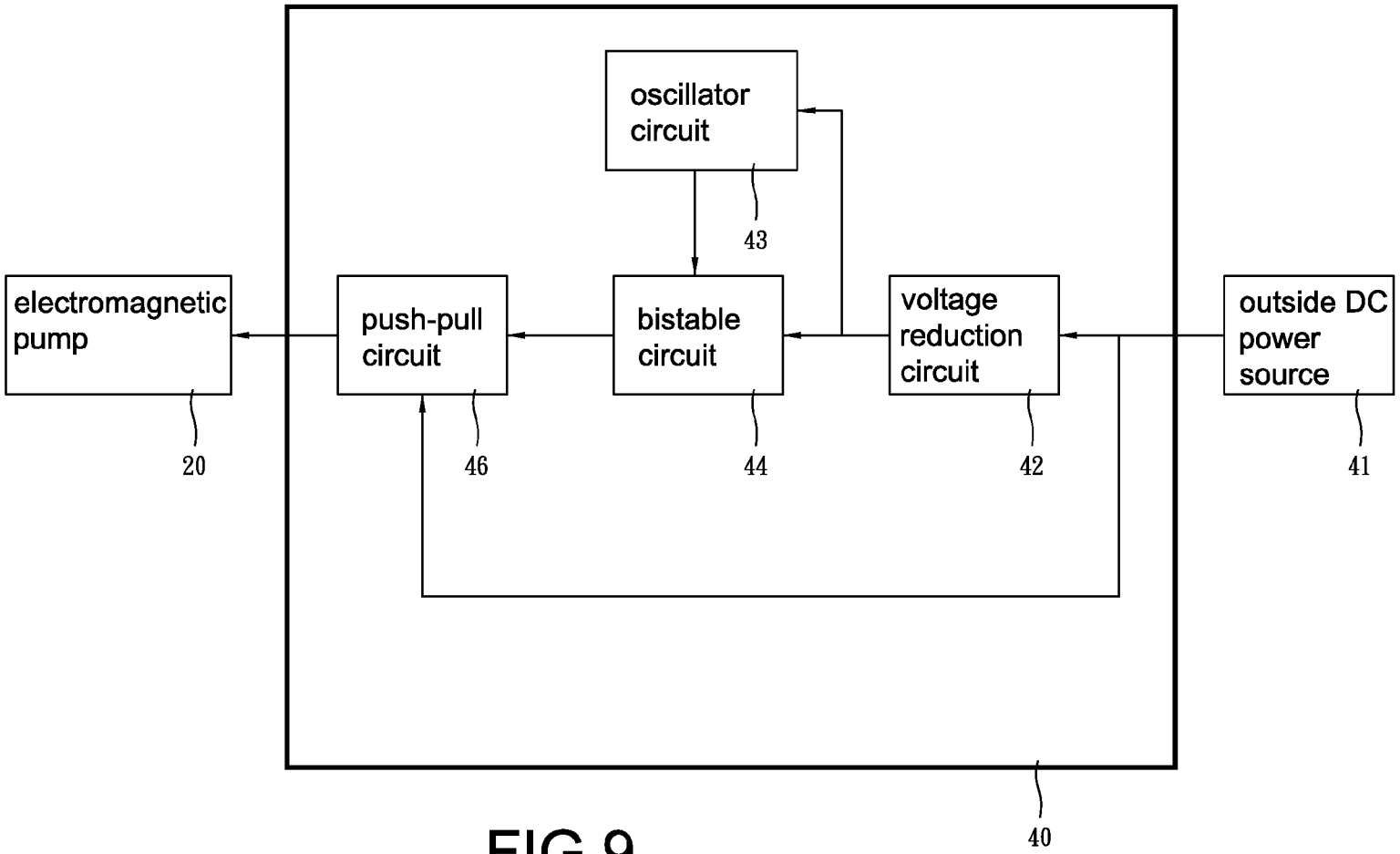
FIG. 9 is a block flow chart of a frequency converter circuit according to the above preferred embodiment of the present invention.
Figure 19:
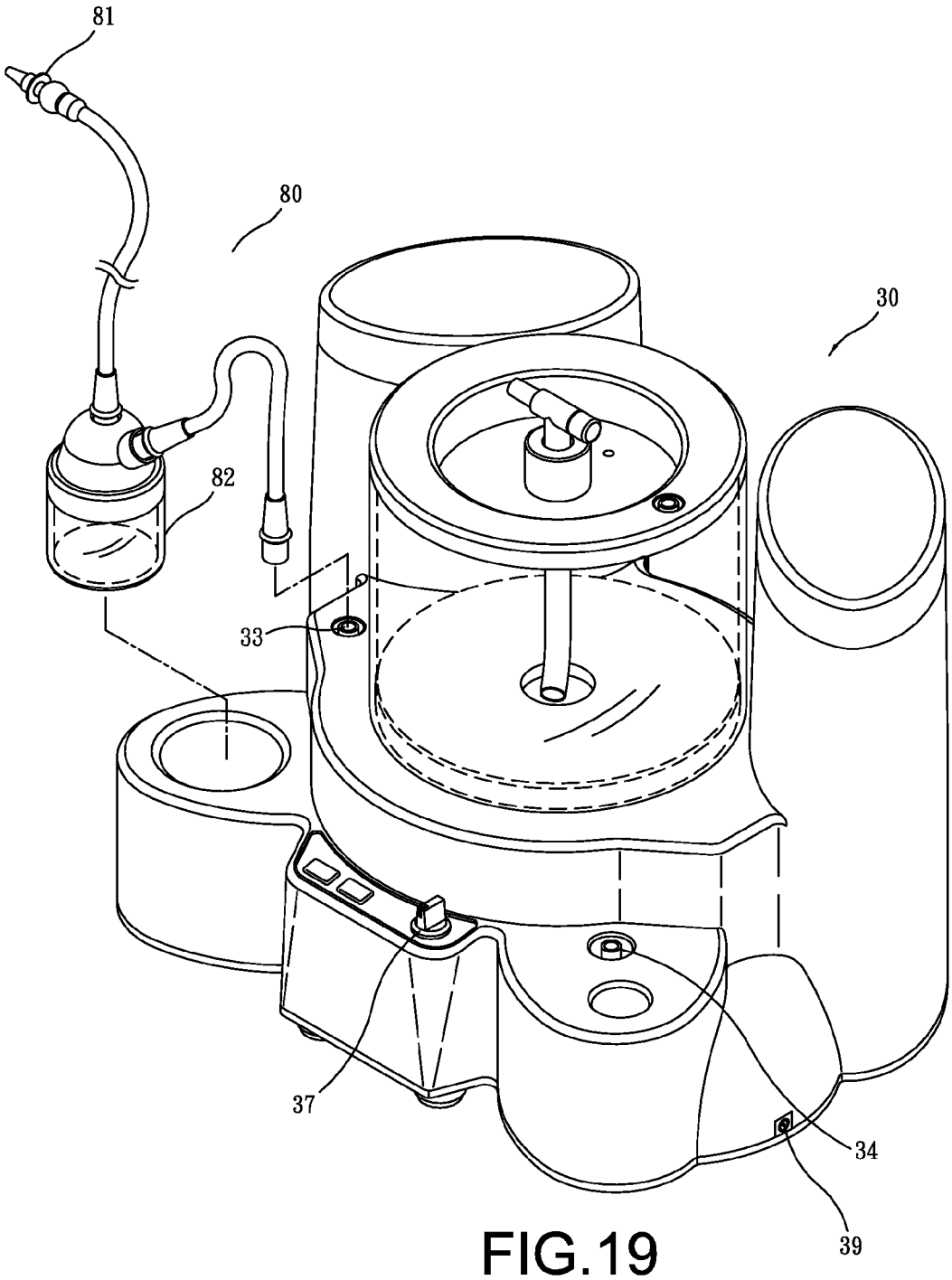
FIG. 19 is a schematic diagram illustrating the connection between the modulation circuit and the button on the outside surface according to the above preferred embodiment of the present invention.
Figure 24:
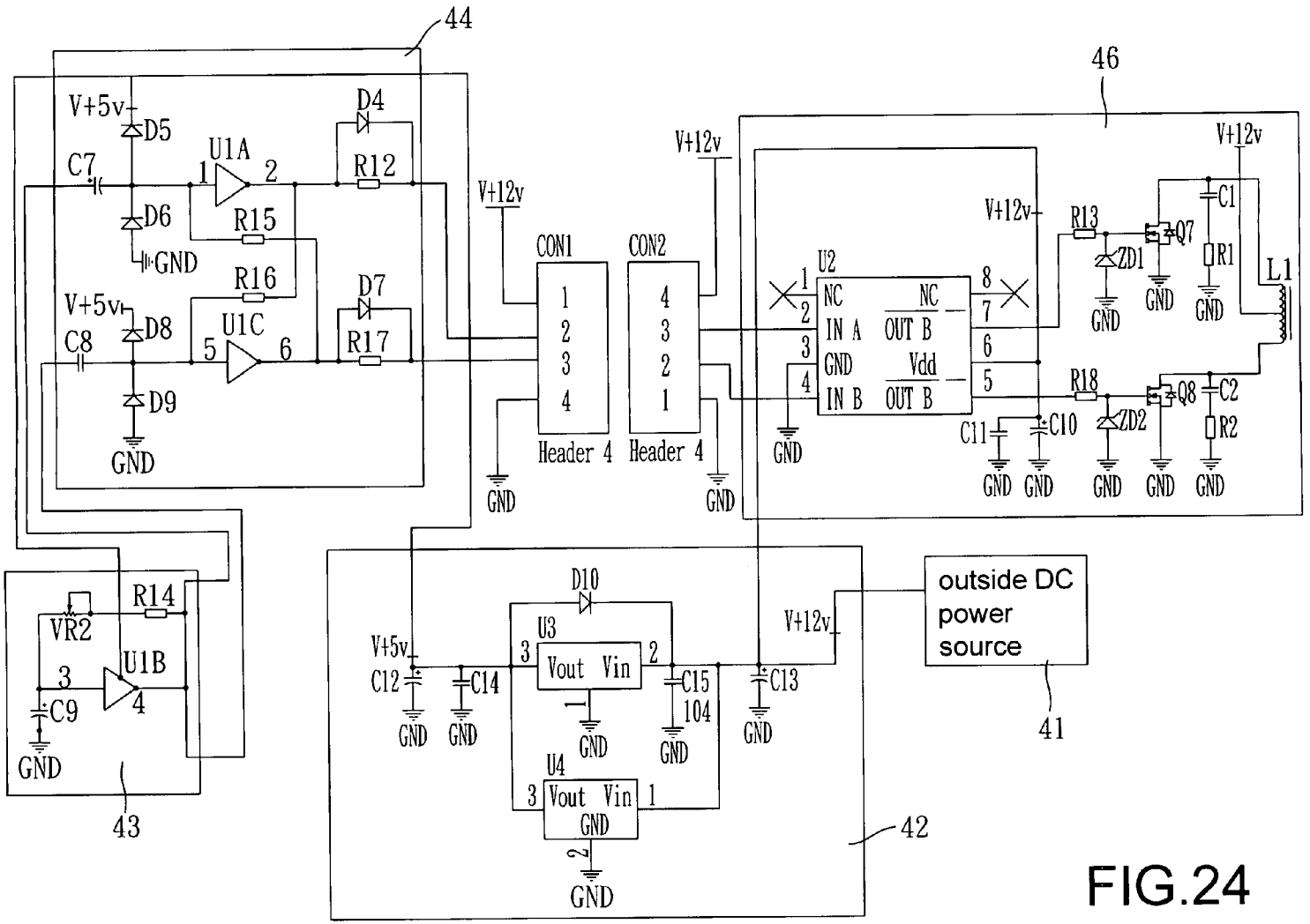
FIG. 24 is a circuit diagram of the frequency converter circuit according to the preferred embodiment of the present invention.

The frequency converter circuit 40 comprises a voltage reduction circuit 42 (sometimes called a "buck converter"), an oscillator circuit 43, a bistable circuit 44 and a push-pull circuit 46. Referring to FIG. 24, a circuit diagram of the above frequency converter circuit 40 as shown in FIG. 9 according to the preferred embodiment of the present invention is illustrated. The voltage reduction circuit 42 transforms the 12V DC inputted by the outside DC power source 41 to 5V DC, which is supplied to each circuit, wherein the voltage reduction circuit 42 could be used to stabilize the voltage. The oscillator circuit 43 could be a Schmitt trigger oscillator circuit, which oscillates to transform a 12V DC into a single-phase oscillating signal with an oscillating frequency between 43 Hz to 66 Hz. Referring to FIG. 19, the oscillator circuit 43 is connected to a button 37 on a body 30, wherein the button 37 is used to activate the oscillating circuit 43 and to adjust the oscillating frequency. The bistable circuit 44 splits the single-phase oscillating signal into a N-phase stimulus signal and a S-phase stimulus signal, both of which respectively activate the magnetism of the two side magnetic members 271 and the magnetism of the middle magnetic member 272 to alternating switch between N-phase and S-phase; accordingly, the two side magnetic members 271 and the middle magnetic member 272 are attracted or repulsed by the two magnetic members 24 respectively to force the swing arms 25 to swing in a reciprocating manner to compress or expand the hats 24 respectively. The push-pull circuit 46 amplifies the N-phase stimulus signal and the S-phase stimulus signal to force the swing arms 25 of the electromagnetic pump 20 to swing, to further improve the power of the electromagnetic pump 20.

Figure 10:
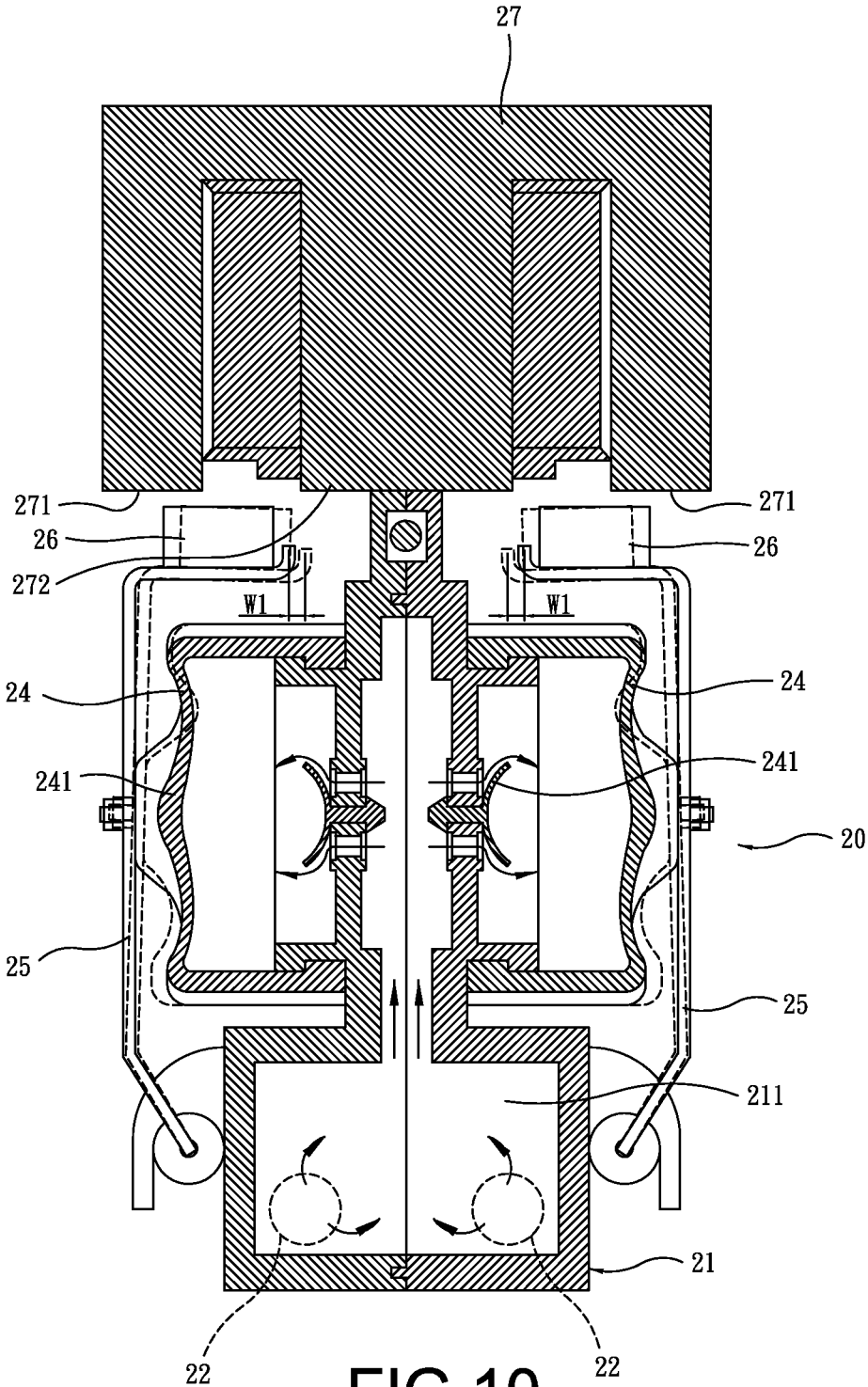
FIG. 10 is a schematic diagram of the electromagnetic pump according to the above preferred embodiment of the present invention illustrating the swinging of the swing arms with maximum frequency and minimum amplitude.
Figure 11:
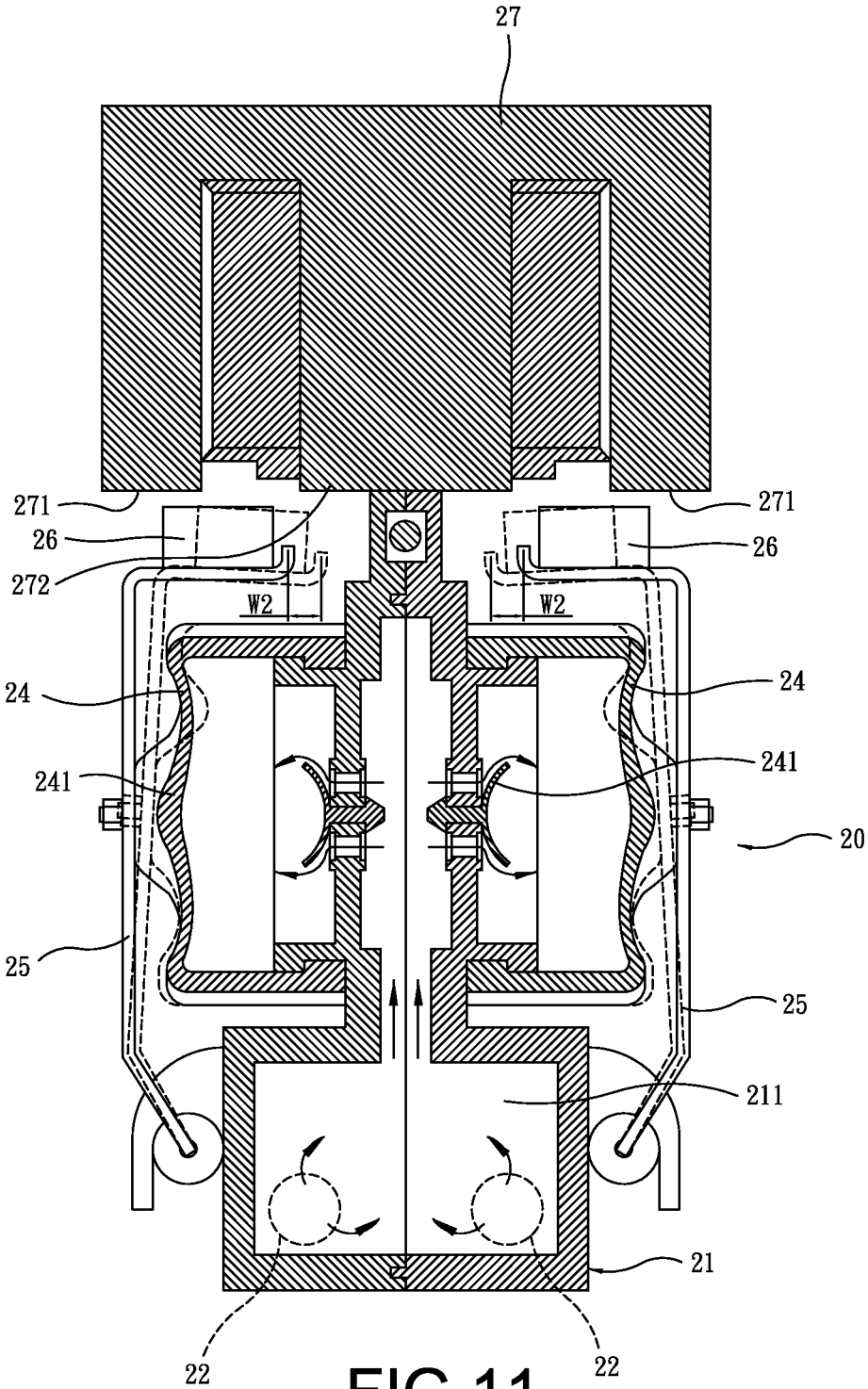
FIG. 11 is a schematic diagram of the electromagnetic pump according to the above preferred embodiment of the present invention illustrating the swinging of the swing arms with medium frequency and medium amplitude.
Figure 12:
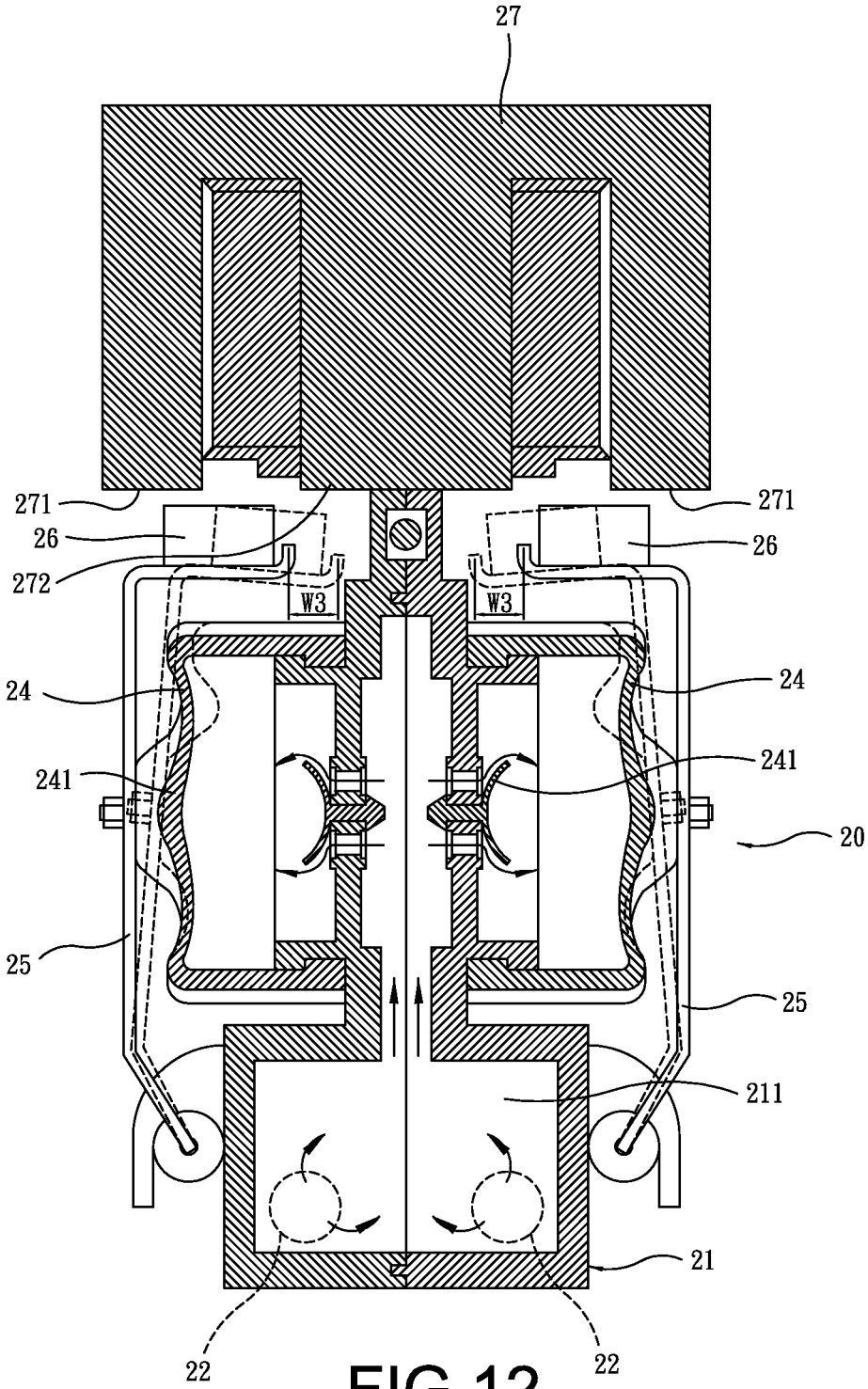
FIG. 12 is a schematic diagram of the electromagnetic pump according to the above preferred embodiment of the present invention illustrating the swinging of the swing arms with minimum frequency and maximum amplitude.
Figure 13:
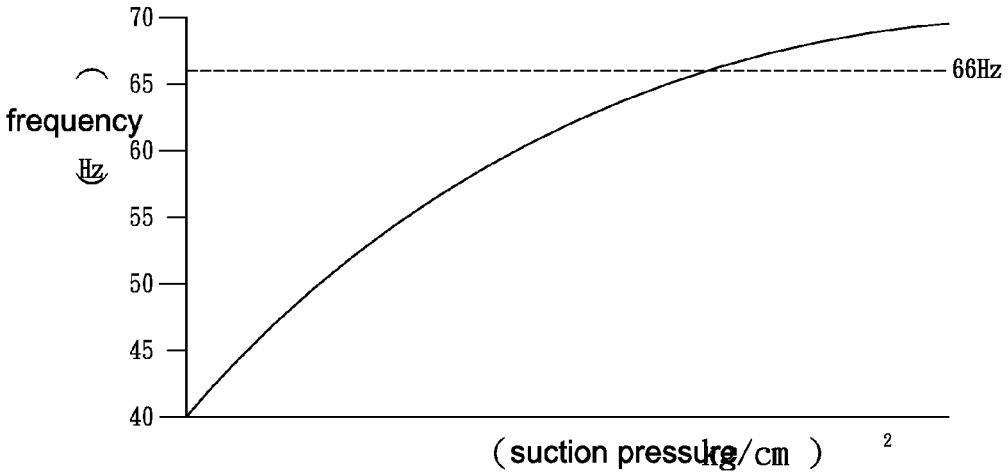
FIG. 13 is a diagram showing the relationship between the oscillating frequency and the suction pressure according to the above preferred embodiment of the present invention.
Figure 14:
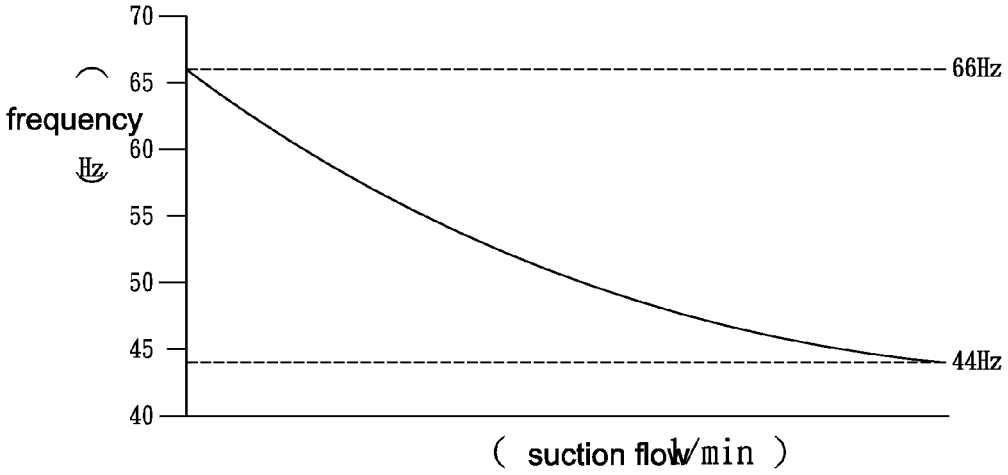
FIG. 14 is a diagram showing the relationship between the oscillating frequency and the suction flow according to the above preferred embodiment of the present invention.

Referring to FIGS. 10 to 11, the higher is the oscillating frequency of the oscillator circuit 43 of the frequency converter circuit 40 of the present invention, the higher is the speed of the switching between the N-phase and the S-phase of the electromagnetic device 27. That, in turn, causes the reciprocating of the swing arms 25 to have a higher speed, a higher frequency and smaller amplitude, shown as W1 in FIG. 10. Referring to FIGS. 13 to 14, as the swing arms 25 swing with a higher speed and frequency, the suction frequency of the electromagnetic pump 20 correspondingly increases so as to increase the suction pressure; and as the swing arms 25 swing with a smaller amplitude, the suction flow of the electromagnetic pump 20 correspondingly decreases. When adjusting the oscillator frequency of the oscillator circuit 43 to a lower frequency such as 43 Hz, the speed of switching between the N-phase and the S-phase of the electromagnetic device 27 decreases to further cause the swing arms 25 have a lower speed, lower frequency and larger amplitude, as shown as W3 in FIG. 12. Due to the decrease of the speed of the swing arms 25, the suction pressure of the electromagnetic pump 20 decreases, and due to the increase of the swing amplitude of the swing arms 25, the suction flow of the electromagnetic pump 20 increases a lot. Therefore, when adjusting the oscillating frequency of the oscillator circuit 43 to a middle frequency such as 55 Hz, the reciprocating swinging of the swing arms 25 have a medium speed, frequency and amplitude, as shown as W2 in FIG. 11. At this time, the suction pressure and flow of the electromagnetic pump 20 are medium. Therefore, the electromagnetic pump 20 could have a higher suction pressure and a lower suction flow by means of adjusting the oscillating frequency of the oscillator circuit 43 to a higher frequency; and the electromagnetic pump 20 could have a lower suction pressure and a higher suction flow by means of adjusting the oscillating frequency of the oscillator circuit 43 to a lower frequency. As mentioned above, when the mucus suction device is in use, if the patient has a lot of mucus, the electromagnetic pump 20 could be adjusted to a low frequency, i.e. the type of low suction pressure and high suction flow, and if the patient has viscous mucus or rhinolith, the electromagnetic pump 20 could be adjusted to a high frequency, i.e. the type of high suction pressure and low suction flow, in order to easily draw the viscous mucus or rhinolith out. As it could not be supposed that the mucus suction device of this preferred embodiment will be used for drawing the mucus or drawing the viscous mucus and rhinolith, when the mucus suction device is produced, the oscillator circuit 43 is set to have a low frequency or a medium frequency that the mucus suction device correspondingly has the type of low suction pressure and high suction flow or the type of medium suction pressure and medium suction flow. However, users could adjust the suction pressure to a higher one—according to their requirements.

Figure 15:
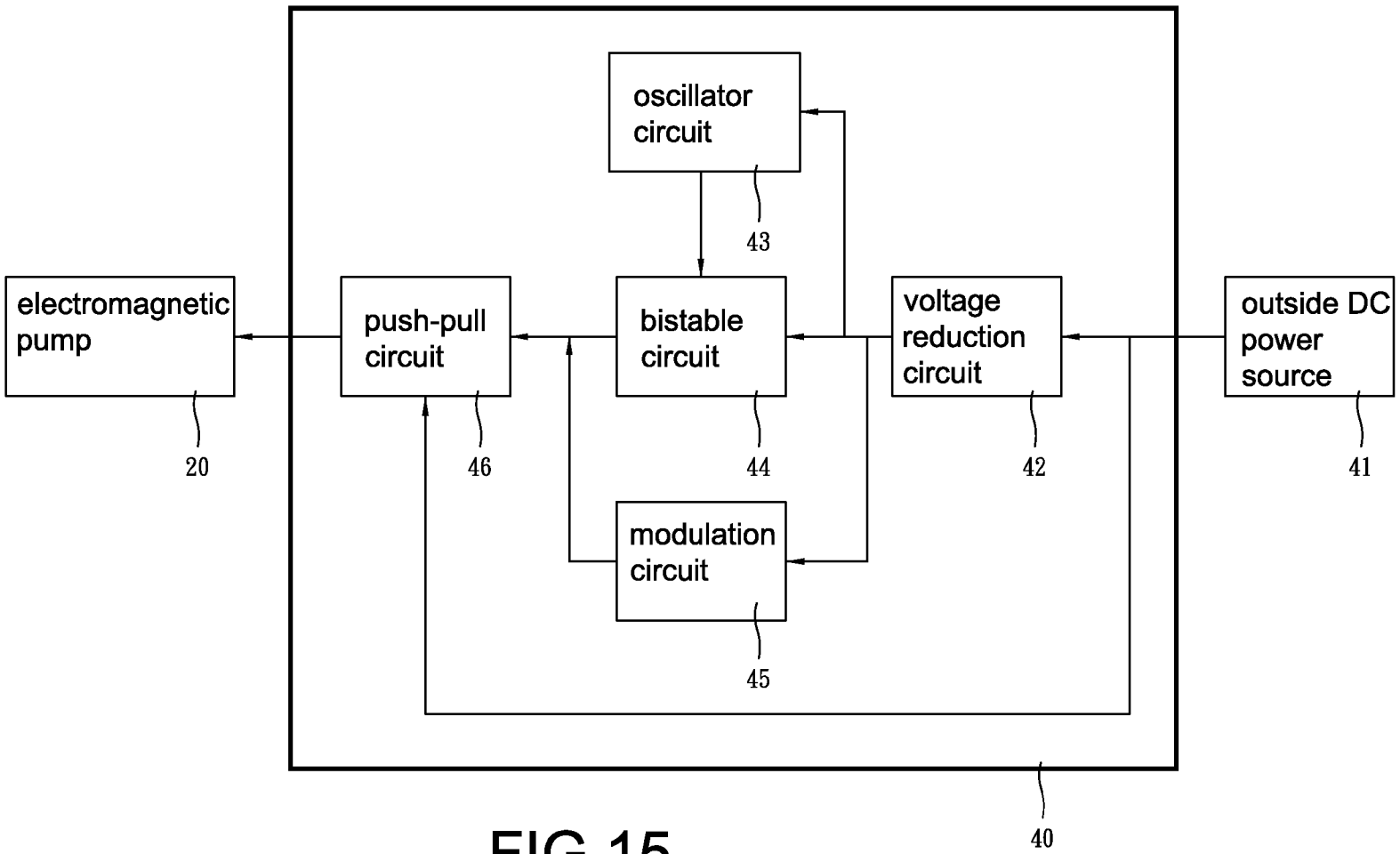
FIG. 15 is a block flow chart of the frequency converter circuit according to a second embodiment of the present invention.
Figure 16:
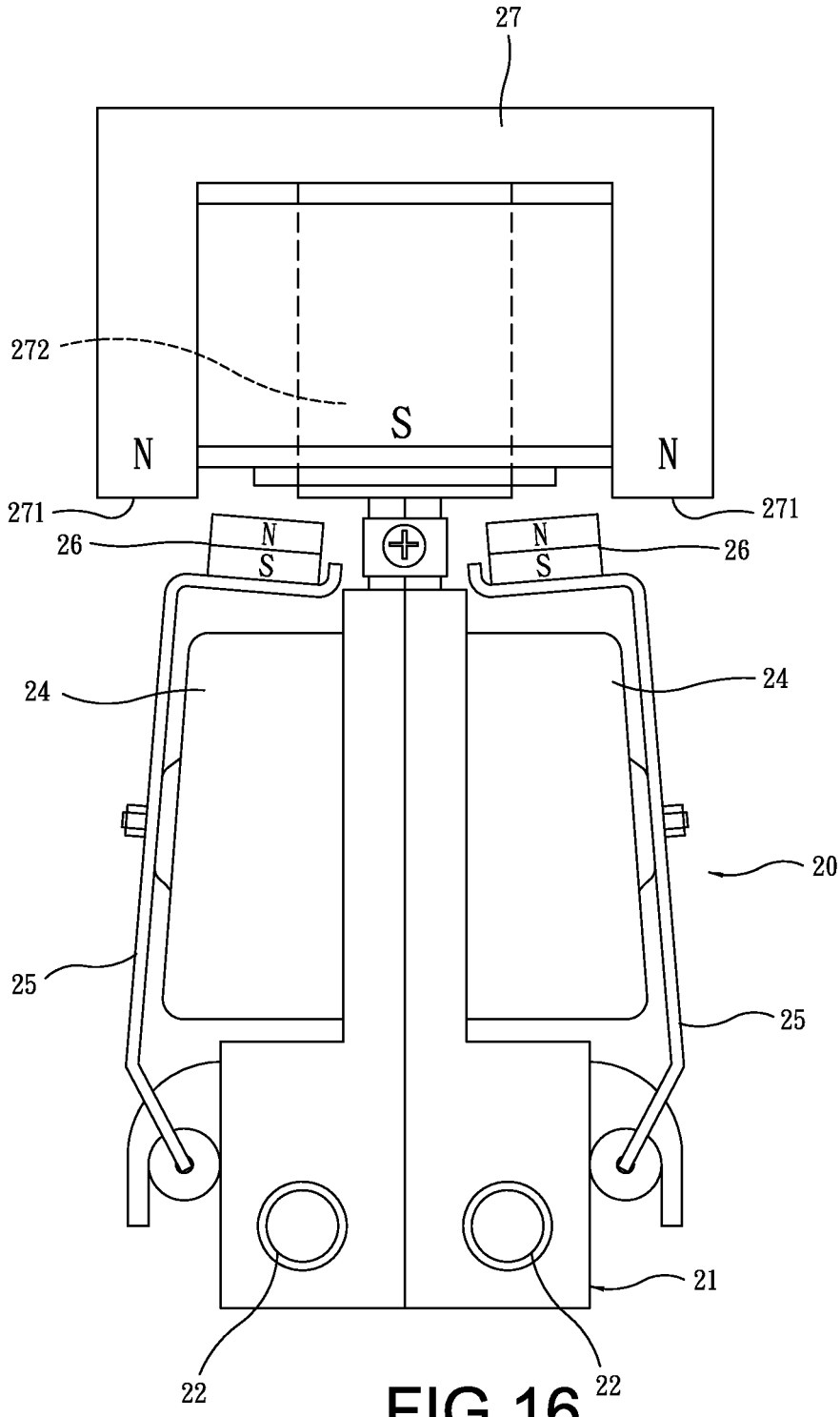
FIG. 16 is a schematic diagram showing the change of the inward swinging of the swing arms after the modulation circuit of the frequency converter circuit is activated according to the above preferred embodiment of the present invention.
Figure 17:
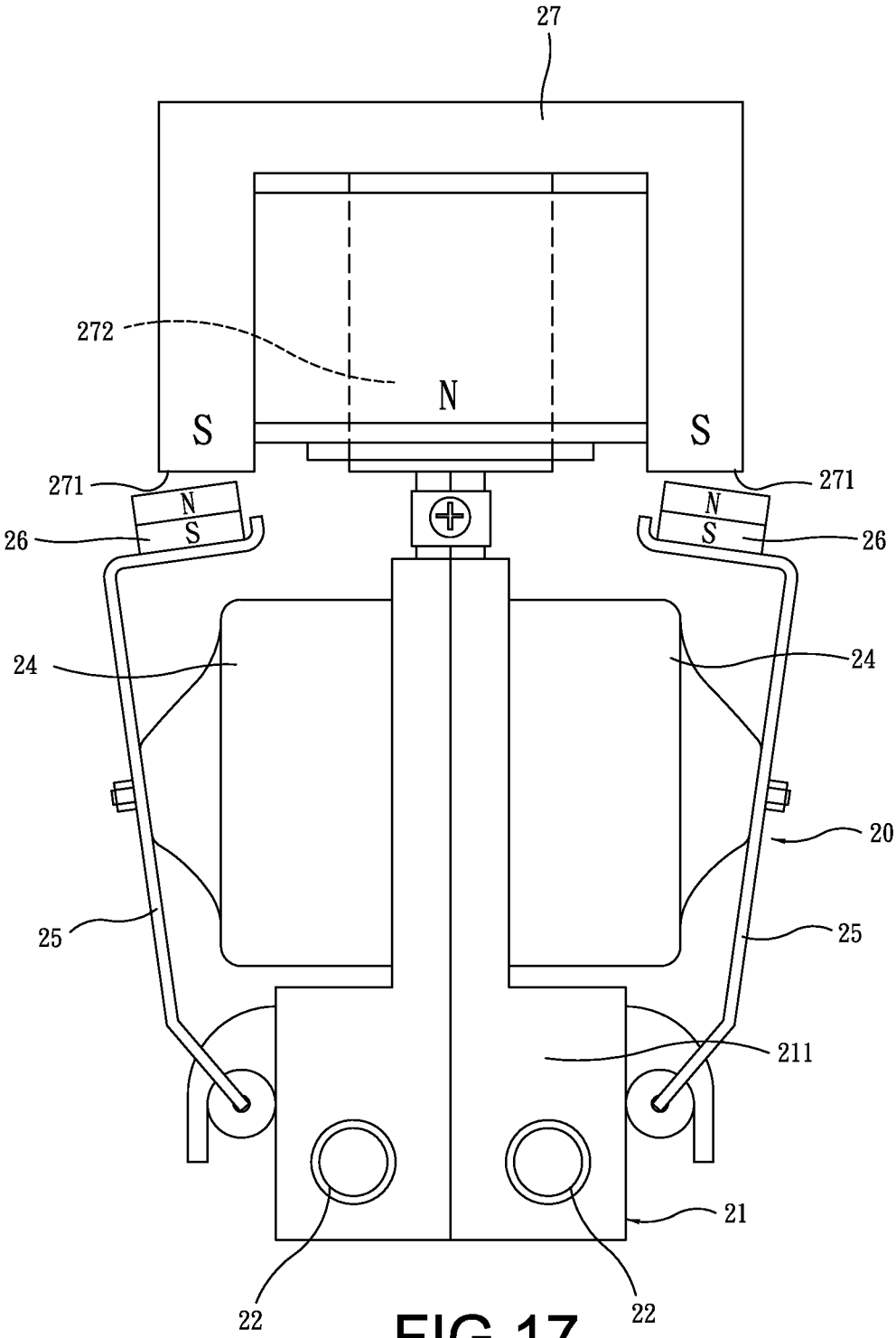
FIG. 17 is a schematic diagram showing the change of the outward swinging of the swing arms after the modulation circuit of the frequency converter circuit is activated according to the above preferred embodiment of the present invention.
Figure 25:
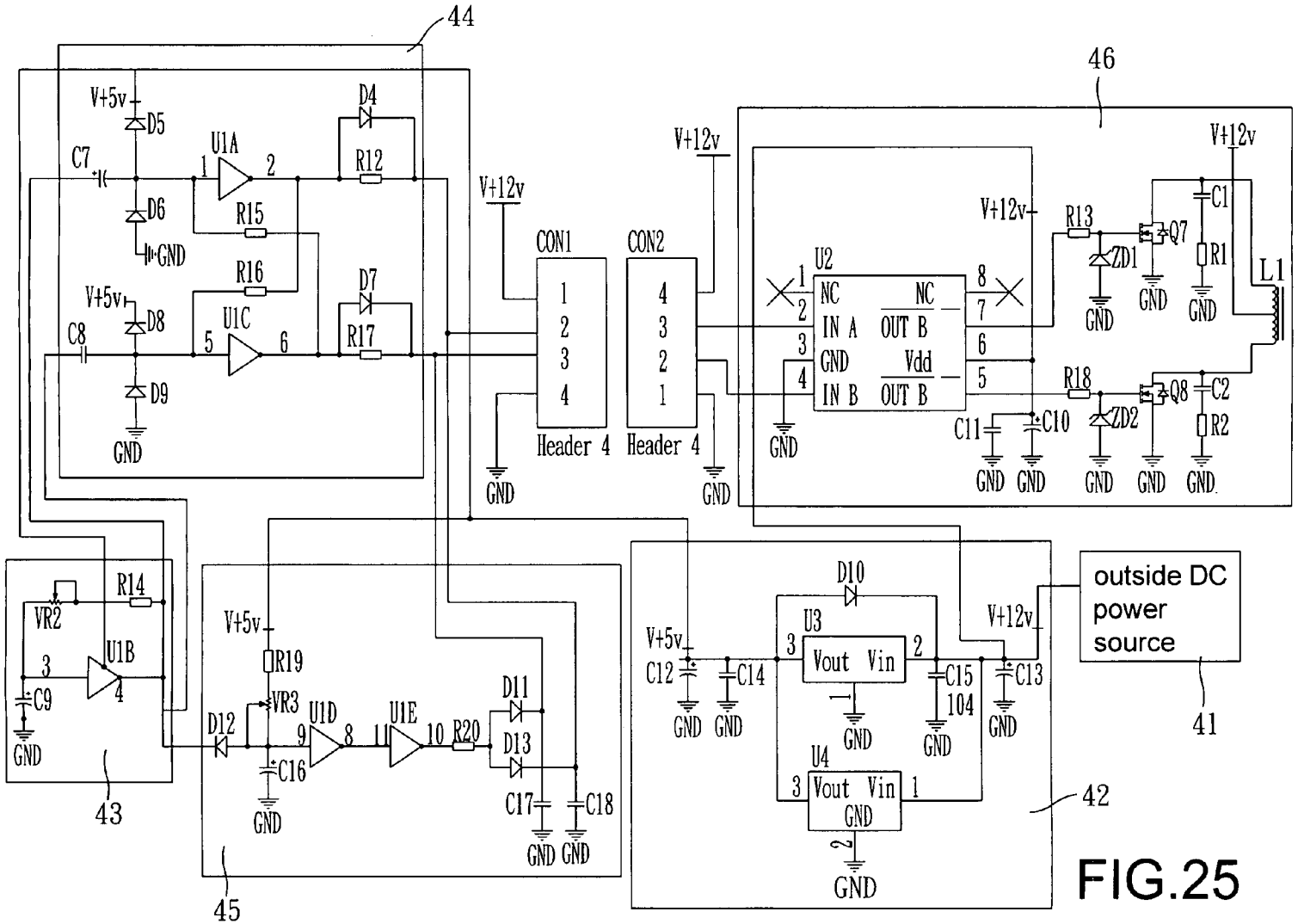
FIG. 25 is a circuit diagram of the frequency converter circuit according to the second embodiment of the present invention.

Referring to FIG. 15, a frequency converter circuit 40 of a mucus suction device according to a second preferred embodiment of the present invention is illustrated, which further comprises a modulation circuit 45 generating a single-phase oscillating signal. FIG. 25 is a circuit diagram illustrating the frequency converter circuit 40 as shown in FIG. 15 according to the second preferred embodiment of the present invention. The N-phase stimulus signal and the S-phase stimulus signal generated in the bistable circuit 44 are mixed with the single-phase oscillating signal respectively to enhance the N-phase stimulus signal while balanced with the S-phase stimulus signal and to enhance the S-phase stimulus signal while balanced with the N-phase stimulus signal respectively, i.e. to enhance the magnetic field strength of the N-phase of the electromagnetic device 27 while balanced with the magnetic field strength of the S-phase of the electromagnetic device 27 and to enhance the magnetic field strength of the S-phase of the electromagnetic device while balanced with the magnetic field strength of the N-phase of the electromagnetic device 27 respectively. The modulation circuit 45 according to the second preferred embodiment is arranged to enhance the magnetic field strength of the N-phase of the electromagnetic device 27 while balanced with the magnetic field strength of the S-phase of the electromagnetic device 27. Referring to FIGS. 16 to 17, when activate the modulation circuit 45, switch the two side magnetic members 271 of the electromagnetic device 27 to the N-phase and switch the middle magnetic member 272 of the electromagnetic device 27 to the S-phase. As the magnetic members 26 are set to have the outside surfaces of N-phase and the inside surfaces of S-phase, the magnetic members 26 are a little attracted by the S-phase middle magnetic member 272 of the electromagnetic device 27, which causes the swing arms 25 swing toward the middle with a lower speed and a smaller force. Accordingly, the electromagnetic pump 20 has a lower discharge pressure and a lower discharge flow. Referring to FIG. 17, switch the middle magnetic member 272 of the electromagnetic device 27 to the N-phase and switch the two side magnetic members 271 of the electromagnetic device 27 to the S-phase. Due to the mixing of the modulation circuit 45, the N-phase stimulus signal is enhanced to cause the N-phase middle magnetic member 272 of the electromagnetic device 27 to have a more powerful magnetic field strength to repulse the magnetic members 26. That in turn causes the swing arms 25 to swing outward with an increased speed and an increased force. Accordingly, the suction pressure and the suction flow of the electromagnetic pump 20 are increased. Thereby, when the modulation circuit 45 is activated, the swing arms 25 swing outward with a higher speed and a bigger force and yet swing toward the middle with a lower speed and a smaller force. The modulation circuit 45 is arranged to enhance the suction pressure of the electromagnetic pump 20, with which the mucus suction device could easily draw mucus or rhinolith out.

Figure 20:
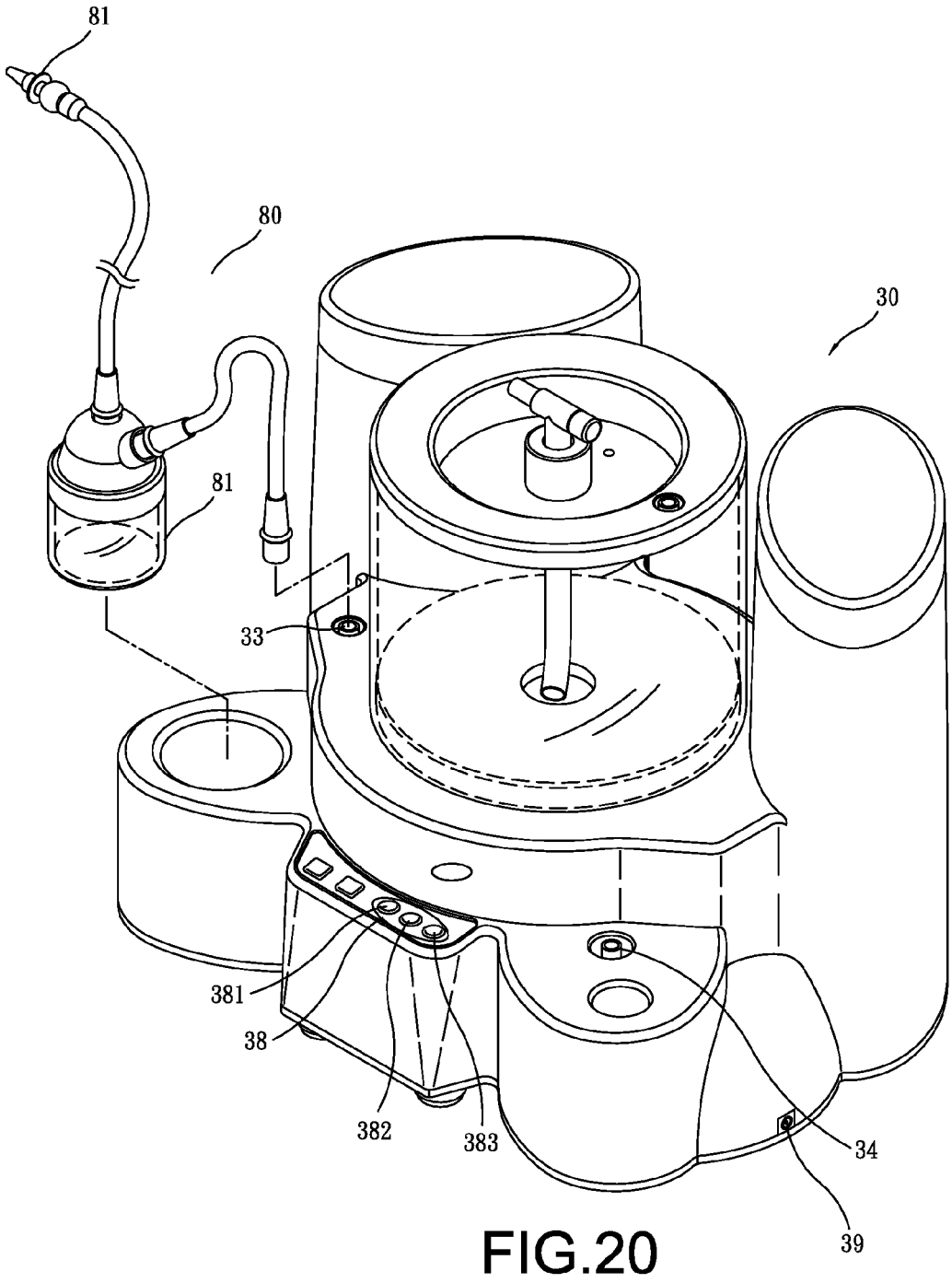
FIG. 20 is a schematic diagram illustrating the connection between the modulation circuit and the keypad on the outside surface according to the above preferred embodiment of the present invention.
Figure 21:
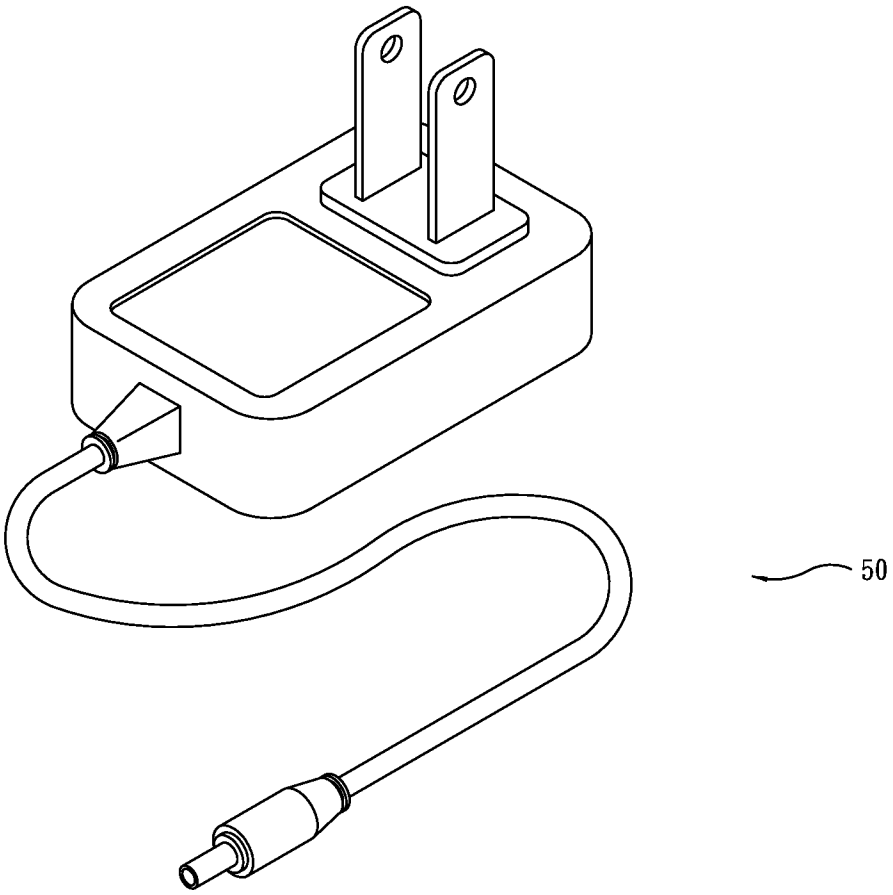
FIG. 21 is a schematic diagram of a transformer rectifier unit.
Figure 22:
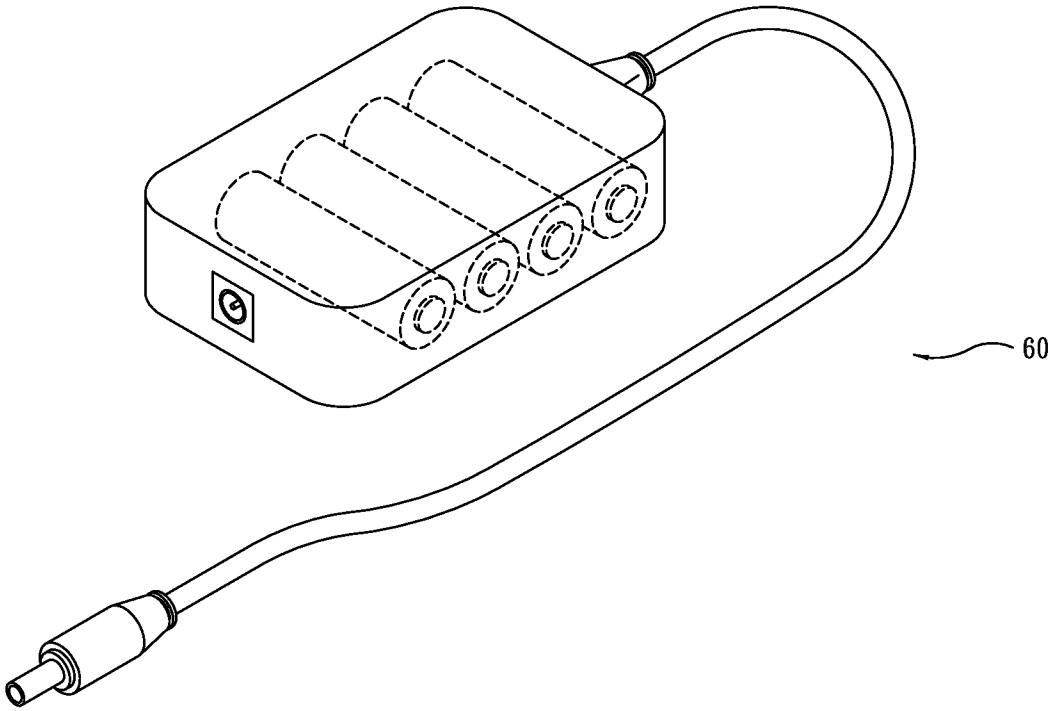
FIG. 22 is a schematic diagram of the battery.
Figure 23:
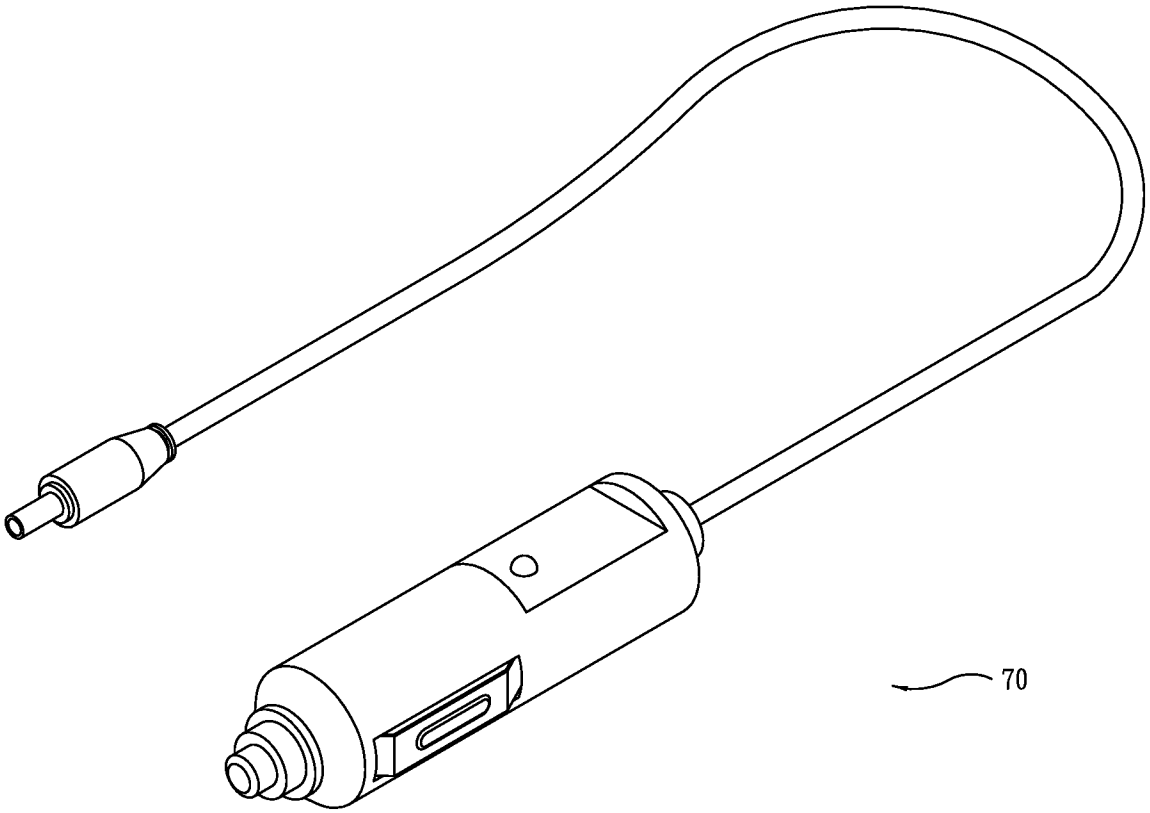
FIG. 23 is a schematic diagram of the electric wire particularly used for the in-car cigarette lighter.

Referring to FIG. 18, the electromagnetic pump 20 and the circuit board 28 of the embodiments could be contained in a body 30. Referring to FIGS. 19 to 20, the modulation circuit 45 is connected to a button 37 or a keypad 38 of the body 30. The button 37 or the keys 381, 382 and 383 of the keypad 38 are arranged to activate the modulation circuit 45 generate a single-phase oscillating signal and to adjust the single-phase oscillating signal. Referring to FIGS. 18 to 20, the body 30 has at least one negative pressure joint 33 and at least one positive pressure joint 34. The negative pressure joint 33 is communicated with the inlet tube 22 of the electromagnetic pump 20 through a negative pressure channel 31. The positive pressure joint 34 is communicated with the outlet tube 23 of the electromagnetic pump 20 through a positive pressure channel 32. The suction device 80 is connected to the negative pressure joint 33 to draw mucus when the electromagnetic pump 20 is activated. The body 30 provides a receptacle for a transformer rectifier unit 50 (TRU), a battery 60 or a wire 70 of in-car cigarette lighter. Referring to FIGS. 21 to 23, the external DC power source 41 of the embodiment is a 12V DC power source such as a transformer rectifier unit 50, a battery 60 or an in-car cigarette lighter, which needs to be connected to the body by a particularly wire 70. Hence, it is very convenient for the users to use the mucus suction device of the present invention at home, in car, or in the suburbs by connecting the mucus suction device to a suitable power source.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A DC-AC frequency converter mucus suction device, which comprises an electromagnetic pump, a suction device and a frequency converter circuit:

wherein said electromagnetic pump has an electromagnetic device on one side and a pump housing on the other side;

wherein at least one outside surface of said pump housing provides a plurality of stretchable and elastic hats, each of which further provides a swing arm thereon, wherein one end of each of said swing arms is disposed on an outer side of said pump housing and a swing arm magnetic member is provided on another end of said corresponding swing arm;

wherein the inside of said pump housing is divided into two chambers including a first chamber communicated with at least one inlet tube and a second chamber communicated with at least one outlet tube;

wherein one check valve is provided between each chamber and corresponding hat;

wherein said swing arms swing in a reciprocating manner to cause said electromagnetic pump to draw a fluid into said chambers from said inlet tube and discharge said fluid from said outlet tube;

wherein said suction device is connected to said inlet tube of said electromagnetic pump and is used to draw mucus out;

wherein said frequency converter circuit comprises an oscillator circuit, a bistable circuit and a push-pull circuit;

wherein said oscillator circuit oscillates to transform DC into a single-phase oscillating signal;

wherein said bistable circuit splits said single-phase oscillating signal into a N-phase stimulus signal and a S-phase stimulus signal, both of which respectively activate magnetism of two side magnetic members of said electromagnetic device as well as magnetism of a middle magnetic member of said electromagnetic device to alternating switch between N-phase and S-phase, wherein said two side magnetic members and said middle magnetic member are attracted or repulsed by said two swing arm magnetic members respectively to force said swing arms to swing in a reciprocating manner;

wherein said push-pull circuit amplifies and provides said N-phase stimulus signal and said S-phase stimulus signal to said electromagnetic pump to force said swing arms of said electromagnetic pump to swing;

wherein said frequency converter circuit is arranged to use DC to activate said swing arms of said electromagnetic pump to swing in a reciprocating manner;

wherein the oscillating frequency of said oscillator circuit is adjustable to change the swing speed, frequency and amplitude of said swing arms, to further change the suction pressure and the suction flow of said electromagnetic pump, whereby said suction device could draw mucus out easily.

2. The DC-AC frequency converter type mucus suction device, as recited in claim 1, wherein said frequency converter circuit comprises a modulation circuit, which generates a single-phase oscillating signal; wherein said N-phase stimulus signal and said S-phase stimulus signal generated in said bistable circuit are mixed with said single-phase oscillating signal respectively to enhance said N-phase stimulus signal while balanced with said S-phase stimulus signal, to further enhance the magnetic field strength of said N-phase of said electromagnetic device; wherein the enhancement of the magnetic field strength of said N-phase of said electromagnetic device further causes said swing arms to swing outward with a higher speed and a bigger force and swing inward with a lower speed and a smaller force, and thus to increase the suction pressure of said electromagnetic pump.

3. The DC-AC frequency converter type mucus suction device, as recited in claim 1, wherein said frequency converter circuit further comprises a voltage reduction circuit, wherein said voltage reduction circuit transforms DC inputted into said frequency converter circuit into DC with a lower voltage, which is supplied to each circuit as the working current; wherein said voltage reduction circuit is used to stabilize the voltage.

4. The DC-AC frequency converter type mucus suction device, as recited in claim 2, wherein said frequency converter circuit further comprises a voltage reduction circuit, wherein said voltage reduction circuit transforms DC inputted into said frequency converter circuit into DC with a lower voltage, wherein said voltage reduction circuit is used to stabilize the voltage.

5. The DC-AC frequency converter type mucus suction device, as recited in claim 1, wherein said DC is supplied by a transformer rectifier unit.

6. The DC-AC frequency converter type mucus suction device, as recited in claim 2, wherein said DC is supplied by a transformer rectifier unit.

7. The DC-AC frequency converter type mucus suction device, as recited in claim 1, wherein said DC is supplied by a battery.

8. The DC-AC frequency converter type mucus suction device, as recited in claim 2, wherein said DC is supplied by a battery.

9. The DC-AC frequency converter type mucus suction device, as recited in claim 1, wherein said DC is supplied by an in-car cigarette lighter, which is connected to said mucus suction device by a wire.

10. The DC-AC frequency converter type mucus suction device, as recited in claim 2, wherein said DC is supplied by an in-car cigarette lighter, which is connected to said mucus suction device by a wire.

11. The DC-AC frequency converter type mucus suction device, as recited in claim 1, wherein said oscillator circuit is a Schmitt oscillator circuit.

12. The DC-AC frequency converter type mucus suction device, as recited in claim 2, wherein said oscillator circuit is a Schmitt oscillator circuit.

13. The DC-AC frequency converter type mucus suction device, as recited in claim 1, wherein said electromagnetic pump is contained in a body, which has at least one negative pressure joint and at least one positive pressure joint; wherein said negative pressure joint is communicated with said inlet tube of said electromagnetic pump through a negative pressure channel, wherein said positive pressure joint is communicated with said outlet tube of said electromagnetic pump through a positive pressure channel; wherein said suction device is connected to said negative pressure joint.

14. The DC-AC frequency converter type mucus suction device, as recited in claim 1, wherein each of said swing arm magnetic members of said swing arms has a N-phase outside surface and a S-phase inside surface.

15. The DC-AC frequency converter type mucus suction device, as recited in claim 2, wherein each of said swing arm magnetic members of said swing arms has a N-phase outside surface and a S-phase inside surface.

16. The DC-AC frequency converter type mucus suction device, as recited in claim 1, wherein said first chamber and said second chamber are arranged in a top-bottom relation.

17. The DC-AC frequency converter type mucus suction device, as recited in claim 2, wherein said first chamber and said second chamber are arranged in a top-bottom relation.

18. The DC-AC frequency converter type mucus suction device, as recited in claim 13, wherein said oscillator circuit is connected to a button of said body, which is arranged to activate said oscillator circuit to generate an oscillation and to adjust the oscillator frequency of said oscillation.

19. The DC-AC frequency converter type mucus suction device, as recited in claim 2, wherein said electromagnetic pump is contained in a body, which has at least one negative pressure joint and at least one positive pressure joint; wherein said negative pressure joint is communicated with said inlet tube of said electromagnetic pump through a negative pressure channel, wherein said positive pressure joint is communicated with said outlet tube of said electromagnetic pump through a positive pressure channel; wherein said suction device is connected to said negative pressure joint.

20. The DC-AC frequency converter type mucus suction device, as recited in claim 19, wherein said modulation circuit is connected to a button of said body, which is arranged to activate said modulation circuit to generate a single-phase oscillating signal and to adjust said single-phase oscillating signal.

21. The DC-AC frequency converter type mucus suction device, as recited in claim 19, wherein said modulation circuit is connected to a keypad of said body having at least one key, which is arranged to activate said modulation circuit to generate a single-phase oscillating signal and to adjust said single-phase oscillating signal.

22. The DC-AC frequency converter type mucus suction device, as recited in claim 1, wherein said suction device has at least one suction tip and at least one mucus container.

23. The DC-AC frequency converter type mucus suction device, as recited in claim 2, wherein said suction device has at least one suction tip and at least one mucus container.

* * * * *